United States Patent [19]

Sekine et al.

[11] Patent Number: 4,984,916

[45] Date of Patent: Jan. 15, 1991

[54] RECORDING APPARATUS HAVING A PLATEN ROTATABLE BETWEEN POSITIONS IN WHICH THE PLATEN FACES AND IS SEPARATED FROM A RECORDING HEAD

[75] Inventors: Kazumi Sekine, Kawasaki; Kaname Suwa, Yokohama, both of Japan

[73] Assignee: Canon Kabushiki Kaisha, Tokyo, Japan

[21] Appl. No.: 300,716

[22] Filed: Jan. 24, 1989

Related U.S. Application Data

[63] Continuation of Ser. No. 6,443, Jan. 23, 1987, abandoned.

[30] Foreign Application Priority Data

| | | | |
|---|---|---|---|
| Jan. 27, 1986 | [JP] | Japan | 61-13848 |
| Jan. 27, 1986 | [JP] | Japan | 61-13849 |
| Feb. 5, 1986 | [JP] | Japan | 61-22058 |
| Feb. 5, 1986 | [JP] | Japan | 61-22059 |
| Feb. 7, 1986 | [JP] | Japan | 61-23855 |

[51] Int. Cl.[5] ..... B41J 15/02

[52] U.S. Cl. ..... 400/613.1; 400/621; 400/649

[58] Field of Search ..... 400/613, 613.1, 621, 400/621.2, 649, 653, 656, 657, 660

[56] References Cited

U.S. PATENT DOCUMENTS

| | | | |
|---|---|---|---|
| 980,277 | 1/1911 | Ireland | 400/656 X |
| 3,572,601 | 3/1971 | Miller | 400/618 |
| 3,905,462 | 9/1972 | Nowak | 400/660 X |
| 4,772,146 | 9/1988 | Saito et al. | 400/613.1 |

FOREIGN PATENT DOCUMENTS

| | | | |
|---|---|---|---|
| 142680 | 11/1980 | Japan | 400/621 |
| 194585 | 11/1983 | Japan . | |
| 35410 | 9/1984 | Japan | 400/613.1 |
| 222373 | 12/1984 | Japan | 400/649 |
| 90785 | 5/1985 | Japan | 400/656 |

*Primary Examiner*—David A. Wiecking

*Attorney, Agent, or Firm*—Fitzpatrick, Cella, Harper & Scinto

[57] ABSTRACT

A platen movable type recording apparatus includes a recording unit for performing a recording operation for a recording medium on a recording surface thereof; a platen having a supporting surface, facing the recording surface of the recording unit, for supporting the recording medium; a cutter, which covers the recording unit and projects across an extending surface of the supporting surface of the platen to cover a portion of the platen, for cutting the recording medium by a knife edge portion thereof after the recording medium passes by the recording unit; and a holder for holding the platen so as to be movable in a direction from a mounting position where the supporting surface of the platen faces the recording surface of the recording unit to a position where the supporting surface is separated from and the recording surface and along and the cutter and the platen cannot interfere with each other upon movement of the platen.

4 Claims, 26 Drawing Sheets

RECORDING APPARATUS HAVING A PLATEN ROTATABLE BETWEEN POSITIONS IN WHICH THE PLATEN FACES AND IS SEPARATED FROM A RECORDING HEAD

This application is a continuation of application Ser. No. 006,443 filed Jan. 23, 1987, now abandoned.

BACKGROUND OF THE INVENTION

1. Field of the Invention

The present invention relates to a recording apparatus (including electronic equipment with a recording apparatus) in which a platen means for supporting a recording medium onto a recording surface of a recording means can be moved from the recording surface of the recording means.

2. Related Background Art

A recording unit for recording a calculation result is often provided in electronic equipment such as an electronic calculator.

In such electronic equipment, the recording unit is stored in a casing of the electronic equipment, and roll paper is used as recording paper serving as a recording medium. The roll paper is often pivotally supported by a roll paper holder that extends outside the housing of the electronic equipment.

The distal end of the recording paper that is unattached from the roll state is guided toward the recording unit through an insertion port as an opening formed in part of the housing of the electronic equipment.

However, electronic equipment of this type has been increasingly miniaturize, and the recording unit and the recording paper holder have been already made as compact as possible. For this reason, it is very awkward to insert the distal end of the unattached recording paper through the insertion port toward the recording unit in order to set a recording enable state.

In order to solve the above problem, a recording apparatus shown in FIG. 1 has been proposed (a patent application describing this apparatus was filed and published in Japan as Japanese Utility Model Publication No. 35410/1984). More specifically, roll paper 1 is stored in a recess portion of a paper casing 8. The distal end of the roll paper 1 is guided to a printing head 6 via a guide 9. A paper cover 2 is arranged above the roll paper 1 and is pivotal about a shaft 4. A portion of the paper cover 2 serves as a platen section 2*a* facing the printing head 6, and has a tension roller 3 which is urged against a feed roller 5 provided to the guide 9. In the above arrangement, when a sheet is to be set between the platen section 2*a* and the printing head 6, the paper cover 2 is opened in the direction indicated by arrow a to set the roll paper in the paper casing 8. Then, the distal end is drawn from the roll paper 1 and is placed on the feed roller 5 and the printing head 6, and the paper cover 2 is closed in the direction indicated by arrow b. However, this conventional apparatus poses the following problem.

In the conventional apparatus, the paper cover 2 is pivoted about the shaft 4. Therefore, nothing can be arranged on the upper surface of the cover 2 because the cover 2 cannot be opened if something is so arranged. A paper cutter for cutting the roll paper is normally arranged in a recording apparatus of this type. The paper cutter is often arranged on the upper surface of the cover 2. However, the paper cutter cannot project from the upper surface of the cover 2 due to the above-mentioned limitation. If the distal end of the paper cutter cannot project from the upper surface of the cover 2, an angle formed by the cutter an the paper becomes obtuse, resulting in poor cutting quality.

Again, if the distal end of the paper cutter cannot project from the upper surface of the cover 2, the paper cutter cannot be expected to wind the sheet around the platen section 2*a*.

In the conventional apparatus, since the paper cover 2 covers the roll paper 1, it becomes a large plate shape, vibrated during recording operation, and thus easily generates noise. In the assignee's copending application Ser. No. 906,079 filed in the United States on Sept. 10, 1986, a technique allowing a platen means to be movable without covering the roll paper has been disclosed.

SUMMARY OF THE INVENTION

It is an object of the present invention to provide a recording apparatus which facilitates a mounting operation of a paper source to be subjected to recording.

It is another object of the present invention to improve the cutting quality of a cutter means.

It is still another object of the present invention to improve the paper supporting force of a platen means.

It is still another object of the present invention to facilitate a mounting operation of a paper source in such a manner that a means for supporting the paper source is moved together with the platen means when the platen means is moved for paper mounting.

Other objects and feature of the present invention will be apparent from the following detailed description.

BRIEF DESCRIPTION OF THE DRAWINGS

FIGS. 2 to 10 are provided for explaining a first embodiment of the present invention, in which FIG. 2 is a perspective view of a recording unit, FIG. 4 is a partially cutaway perspective view of a platen cover, FIG. 5 is a partially cutaway front view of a state wherein the platen is closed, FIG. 6 is a partially cutaway front view of a state wherein the platen is open, FIG. 7 is a perspective view of an electronic calculator, FIG. 8 is an enlarged sectional view of a main part, and FIGS. 9 and 10 are side views of the electronic calculator respectively in the states wherein the platen is open and closed;

FIGS. 11 to 20 are provided for explaining a second embodiment of the present invention, in which FIG. 11 is a plan view showing a mounting method of recording paper, FIG. 12 is a perspective view of an electronic calculator, FIG. 13 is a perspective of a recording unit wherein a platen is open, FIG. 14 is a perspective view of the recording unit wherein the platen is closed, FIGS. 15 to 17 are a plan view, a front view and a side view of the main part of the platen, FIG. 18 is a perspective view of a platen cover, FIG. 19 is a sectional view of a state wherein the platen cover is mounted, and FIG. 20 is a partially cutaway side view of the electronic calculator;

FIGS. 21 to 31 are provided for explaining a third embodiment of the present invention, in which FIG. 21 is a perspective view of an electronic calculator, FIG. 22 is a perspective view of a recording unit, FIG. 23 is a perspective view of a platen cover, FIG. 24 is a partially cutaway front view when the platen is closed, FIG. 25 is a partially cutaway front view when the platen is open, FIG. 26 is an exploded perspective view as viewed from the bottom of the main part, FIGS. 27 and 28 are a plan view and a cross-sectional view of the main part, FIGS. 29 and 30 are cross-sectional views showing an operating method, and FIG. 31 is a partially cutaway side view of the electronic calculator;

FIGS. 32 to 42 are provided for explaining a fourth embodiment of the present invention, in which FIGS. 32 and 33 are sectional views of the main part when a platen is open and closed, FIG. 34 is a perspective view of an electronic calculator, FIG. 35 is a perspective view of a recording unit, FIG. 36 is a partially cutaway perspective view of a platen cover, FIG. 37 is a front view of the recording unit, FIG. 38 is a perspective view of a paper cutter, FIGS. 39 to 41 are a plan view, a front view, and a side view of the main part of the platen, and FIG. 42 is a partially cutaway side view of the electronic calculator; and FIGS. 43 to 52 are provided for explaining a fifth embodiment of the present invention, in which FIG. 43 is a plan view showing a mounting method of recording paper, FIG. 44 is a perspective view of an electronic calculator, FIG. 45 is a perspective view of a recording unit when a platen is open, FIG. 46 is a perspective view of the recording unit when the platen is closed, FIGS. 47 to 49 are a plan view, a front view, and a side view of the main part of the platen, FIG. 50 is a perspective view of a platen cover, FIG. 51 is a sectional view when the platen cover is mounted, and FIG. 52 is a partially cutaway side view of the electronic calculator

DETAILED DESCRIPTION OF THE PREFERRED EMBODIMENTS

Figure 6:
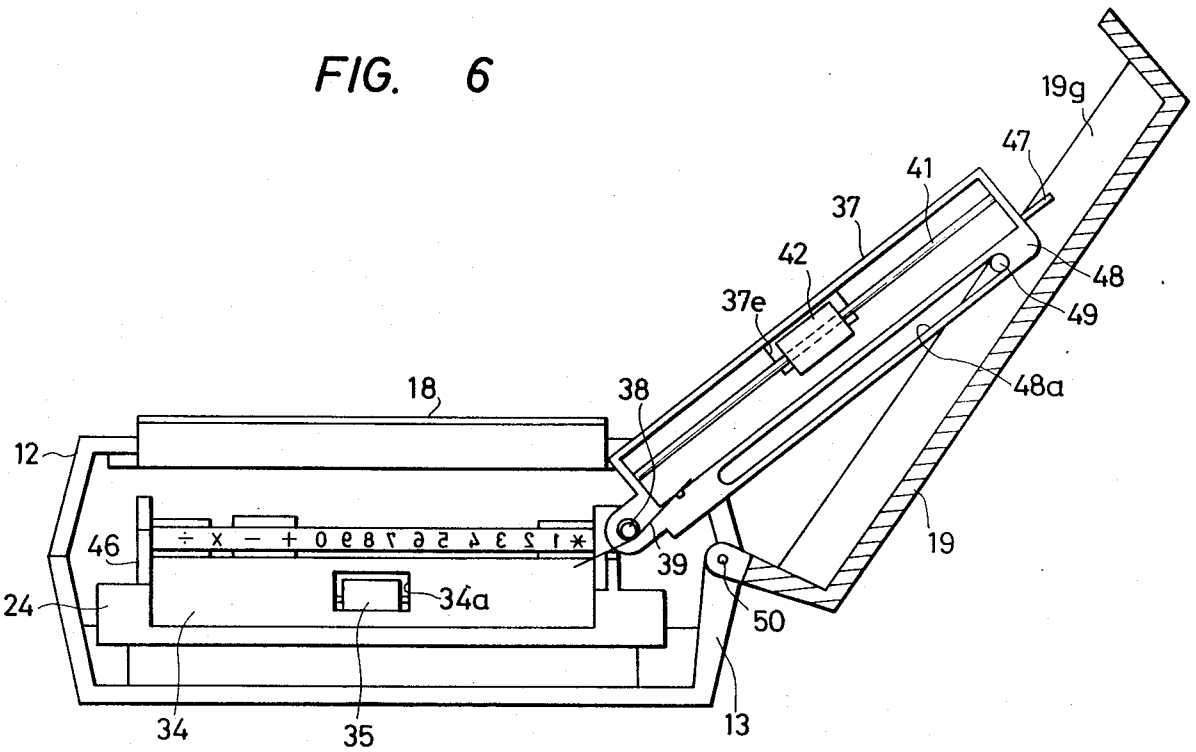
Figure 7:
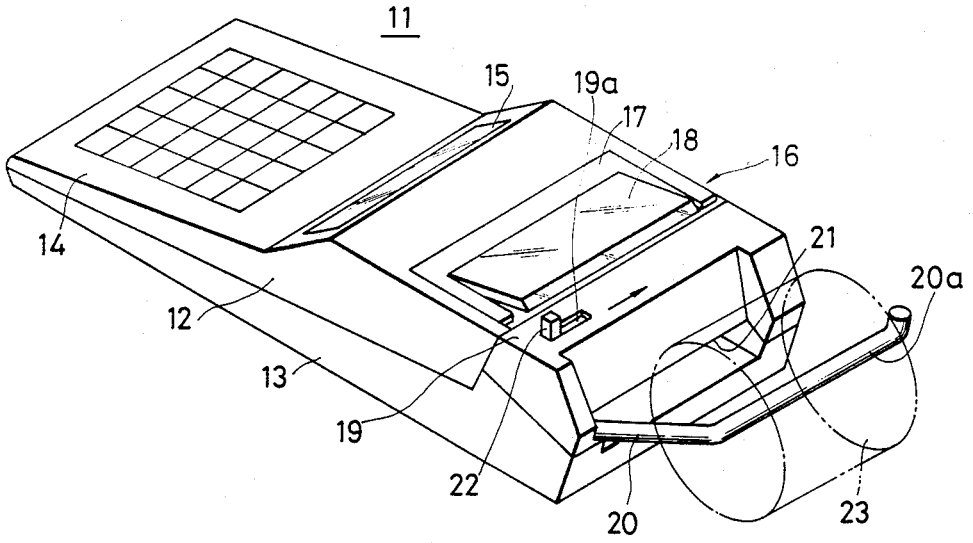

FIGS. 2 to 10 are provided for explaining a first embodiment of the present invention, and FIG. 7 shows the outer appearance of an electronic calculator as one example of a recording apparatus (including electronic equipment with a recording apparatus).

A electronic calculator 11 comprises upper and lower casings 12 and 13. A keyboard section 14 is arranged on the front side of the upper casing 12, and a display section 15 comprising a liquid crystal display is arranged at substantially the central portion of the casing 12.

A recording section 16 is arranged on the rear end portion of the calculator 11. A recording unit arranged in the recording section 16 will be described later in detail. A lid 17 covering the recording section, a paper cutter 18, a platen cover 19, and a roll paper holder 20 are the components viewed from the outside, and an insertion port 21 for recording paper is formed below the platen cover 19.

A locking lever 22 for a platen (to be described later) extends from the upper surface of the platen cover 19 through an opening 19*a*.

The roll paper holder 20 is formed by bending a steel rod, and has a horizontal arm 20*a* for axially supporting roll paper 23.

Figure 1:
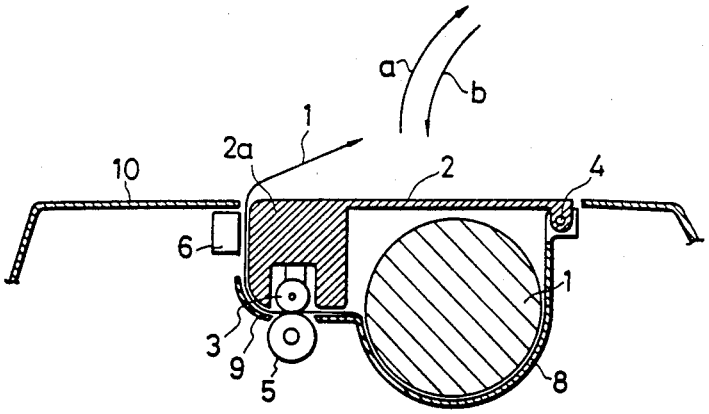
FIG. 1 PRIOR ART
FIG. 1 is a sectional view of a conventional recording apparatus.
Figure 2:
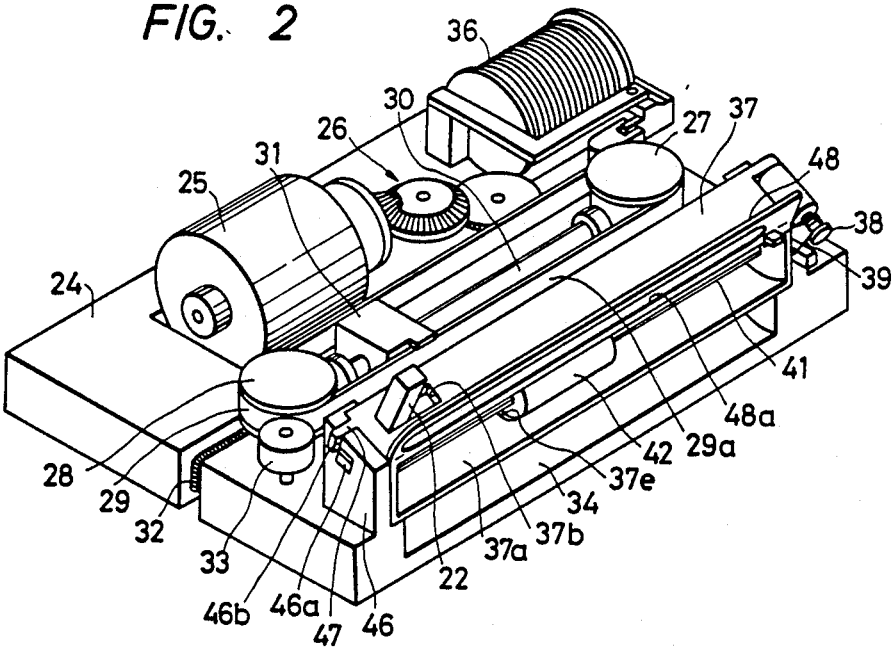

FIG. 2 shows in detail the recording unit stored in the recording section 16 of the electronic calculator.

Referring to FIG. 2, a motor 25 is arranged on a rear portion of a base 24. The rotation of the motor 25 is transmitted to a driving pulley 27 through gears 26.

A driven pulley 28 is arranged opposite to the driving pulley 27, and a font belt 29 is looped therebetween in an endless condition.

As shown in FIG. 6, fonts such as numerals and symbols are integrally formed on the outer peripheral surface of the font belt 29.

A carriage shaft 30 is arranged in an elongated space defined by the font belt 29, and a carriage 31 incorporating a hammer (not shown) is movably mounted on the shaft 30.

The recording unit also includes a coil spring 32 for returning the carriage, an ink roller 33 for applying ink to the fonts on the font belt 29, and a solenoid 36 for stopping the font belt 29. The solenoid 36 also carries and drives the hammer.

The font belt 29 and the carriage 31 constitute a printing head, with its printing surface being formed on the surface of the font belt 29 located at a position facing a platen 37.

A recording paper guide portion 34 having an arcuate surface is arranged on the distal end side of the base 24 in FIG. 2, and an opening 34*a* is formed on substantially the central portion of the guide portion 24 along its longitudinal direction. A feed roller 35 faces the opening 34*a* (FIG. 6).

The feed roller 35 is rotated by a driving mechanism (not shown).

The platen 37 has a hollow frame structure. The surface of the platen 37 facing the guide portion 34 is curved in the same manner as that of the guide portion 34. The platen 37 has an opening 37*a* on its front side in FIG. 2.

The platen 37 is supported at one end thereof on the base 24 through a supporting shaft 38 which is inclined downward toward the rear portion of the electronic calculator, so as to be pivotal obliquely upward. A torsion coil spring 39 is wound around the supporting shaft 38 to apply a clockwise (obliquely upward) torsion force in FIG. 2 to the platen 37. A pivotal limit of the platen 37 is defined by the platen cover 19 (to be described later).

A paper supporting surface R (FIG. 8) of the platen 37 forms substantially a right angle with a bottom surface of the lower casing 13, and parallel-faces the printing surface 29*a* of the printing head 29. Thus, printing can be performed at a position between the surfaces R and 29*a*.

A pinch roller shaft 41 formed of a metal such as stainless steel, or plastic is horizontally suspended in the opening 37*a* of the platen 37.

A pinch roller 42 urged against the feed roller 35 is rotatably supported at the central portion of the pinch roller shaft 41.

The locking lever 22 as described above is mounted on the free end side of the platen 37.

Figure 3A:
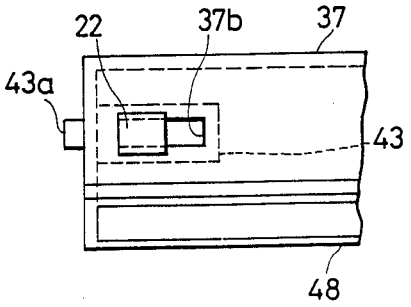
FIGS. 3(A) to 3(C) are respectively a plan view, a front view, and a side view of the main part of a platen.
Figure 3B:
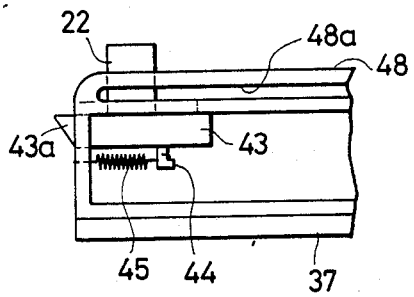
Figure 3C:
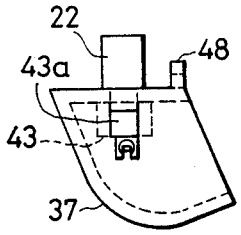

More specifically, as shown in FIGS. 3A to 3C an elongated hole 37b is formed in the upper surface of the platen 37 on the free end side along the longitudinal direction, and the locking lever 22 having a head portion larger than the width of the elongated hole 37b is fitted in the elongated hole 37b from the top.

The lower end of the locking lever 22 is fitted in a block 43 arranged below the elongated hole 37b through a shaft (not shown) having substantially the same width as that of the elongated hole 37b.

The block 43 is larger than the elongated hole 37b.

Therefore, the locking lever 22 and the block 43 are slidably arranged to sandwich the upper plate of the platen 37 therebetween.

A pawl 43a having an inclined surface (lower surface) at the side of the base 24 projects from the distal end of the block 43. The pawl 43a can slidably extend through the side wall of the platen 37 on the free end side.

A pin 44 projects from the lower surface of the block 43. A tension coil spring 45 is extended between the pin 44 and the side wall of the platen 37 on the free end side, so as to bias the locking lever 22 and the block 43 toward the left as shown in FIGS. 3A, 3B, and 3C, thereby continuously projecting the pawl 43a.

On the side of the base 24, the side plate 46 vertically projects from the block 43 on the left side of the guide portion 34 in FIG. 2. A through hole 46a engaged with the pawl 43a is formed in the side plate 46, and a notch 46b is formed in the rear corner portion in FIG. 2. The notch 46b is engaged with a projection 47 projecting from the free end portion of the platen 37 so as to position it.

When the locking lever 22 is pulled to disengage the pawl 43a from the through hole 46a, the platen 37 is opened by the torsion force of the torsion coil spring 39.

When the platen 37 is pushed toward the base 24 against the force of the torsion coil spring 39, the inclined surface of the pawl 43a is pushed by the side plate 46 to move the block 43 backward. Then the pawl 43a is filled in the through hole 46a by the force of the tension coil spring 45, thereby locking the platen 37.

At this time, the pinch roller shaft 41 is flexed and the pinch roller 42 is urged against the feed roller 35 through the opening 37e of the platen 37 to sandwich the recording paper therebetween.

Note that the locking lever, the pawl, and the like may be arranged on the base 24, and the through hole may be formed in the platen.

A projection 48 is formed on the end portion of the platen 37 on the front side in FIG. 2, and an elongated hole 48a is formed along the longitudinal direction of the projection 48.

Figure 4:
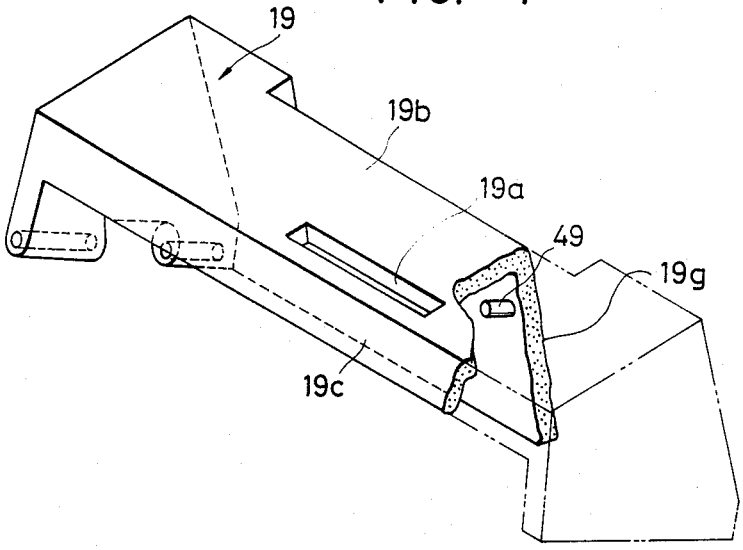
Figure 5:
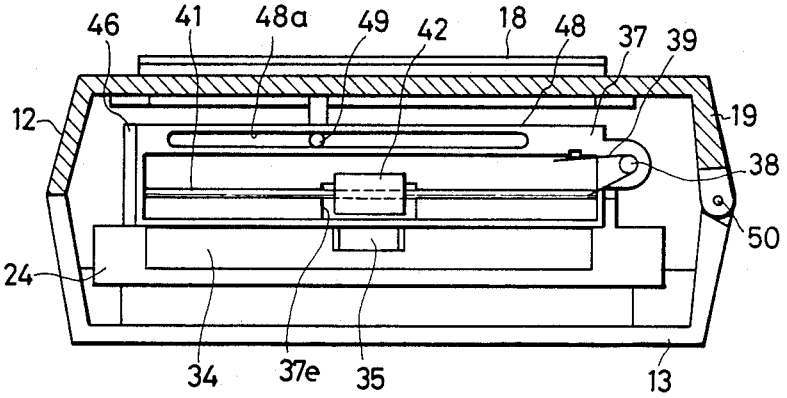

The platen cover 19 engaged with the platen 37 is arranged as shown in FIG. 4.

More specifically, the platen cover 19 is formed into a roof-like shape to entirely cover the platen 37 and to constitute part of the outer appearance of the apparatus such as the electronic calculator. An elongated hole 19a in which the locking lever 22 is fitted is formed in an upper plate 19b of the cover 19. A side tip 19c projects downward from the side edge of the upper plate 19b on the side of the electronic calculator main body (inside).

A pin 49 which is slidably fitted in the elongated hole 48a of the platen 37 projects from the inner surface of a side plate 19g of the platen cover 19 on the rear side of the electronic calculator 11.

One end of the platen cover 19 having the above structure is pivotally supported by the lower casing 13 through a shaft 50 outside the supporting shaft 38 of the platen, as shown in FIG. 6.

The operation of this embodiment with the above arrangement will now be described.

When the recording paper is to be mounted, the locking lever 22 is pulled to the right as indicated by an arrow in FIG. 7 from the state wherein the platen cover 19 is closed together with the platen 37. Then, the platen 37 and the platen cover 19 which are disengaged from each other by the force of the torsion coil spring 39 are pivoted clockwise in FIG. 6 about the supporting shaft 39 and are opened obliquely upward. Therefore, the platen 37 will not interfere with the paper cutter 18.

At this time, because the platen 37 and the platen cover 19 are pivoted about their individual shafts 39 and 50 respectively, their pivoting paths are different from each other. However, this difference is absorbed because the pin 49 is moved in the elongated hole 48a, and the platen 37 and the cover 19 are cooperatively pivoted.

Note that pivotal limit of the platen 37 and the platen cover 19 corresponds to a position at which the pin 49 reaches the distal end of the elongated hole 48a.

In this state, the roll paper 23 is mounted on the horizontal arm 20a of the roll paper holder 20.

In this case the roll paper 23 is mounted so that its one end 23a is unattached from the bottom side.

One end 23a of the recording paper is guided from the open platen 37, and is placed on the guide portion 34. Then, the paper is drawn upward by a predetermined length (FIG. 9) and is aligned using the right and left side walls of the guide portion 34. In this state, when the platen 37 is pivoted together with the platen cover 19 and they are pushed toward the electronic calculator, they are closed to be interlocked with each other, and the pawl 43a abuts against the side plate 46.

The pawl 43a retracts as described above, and is then fitted in the opening 46a and locked.

At this time, one end 23a of the roll paper is clamped between the feed roller 35 and the pinch roller 42. The urging force at this time is determined by an elastic force of the pinch roller shaft 41.

Figure 8:
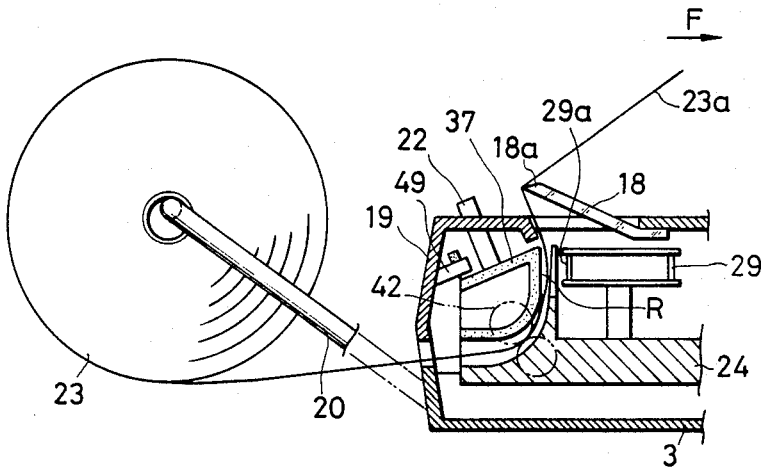
Figure 9:
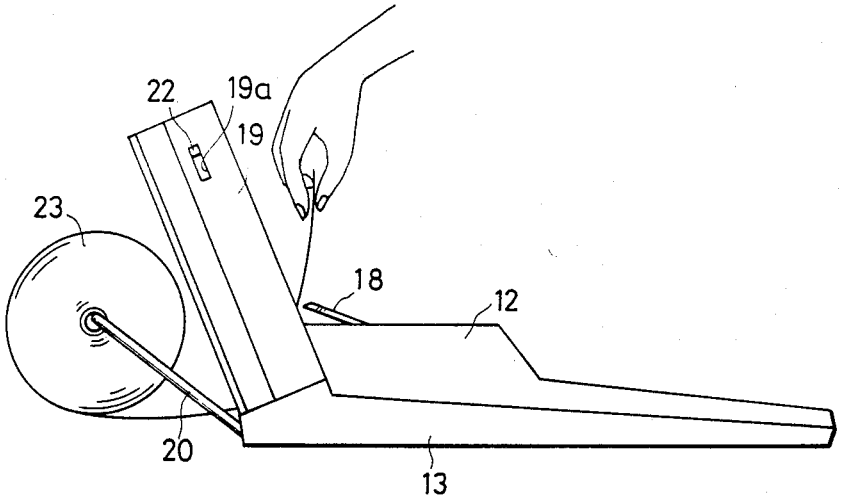
Figure 10:
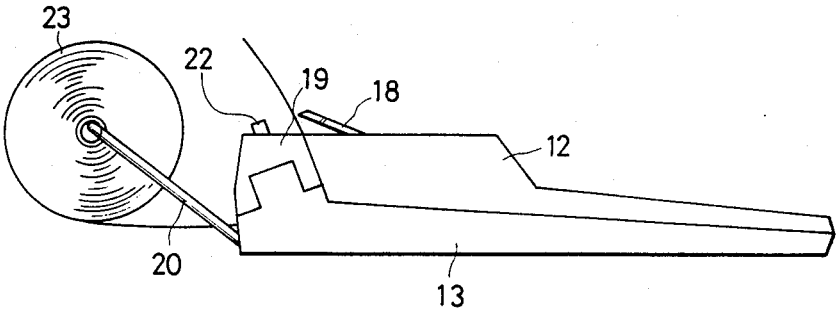

When the recording paper is mounted in this manner, because one end 23a of the paper is curled, it passes along the supporting surface R of the platen 37, as shown in FIG. 8, and is then guided upward through a gap between the distal end of the paper cutter 18 and the platen cover 19 (FIG. 10).

In this state, a recording operation is performed upon operation of the keyboard section 14.

When the recording paper is to be cut, one end 23a of the recording paper abuts against the distal end of the paper cutter 18 and is then pulled toward the front side of the electronic calculator as indicated by arrow F, as shown in FIG. 8.

At this time, a distal end blade portion 18a of the cutter 18 projects across the extending surface of the supporting surface R of the platen 37 so as to cover not only the printing head but also a portion of the platen 37. Therefore, the recording paper is strongly urged against the inner surface of the platen 37, and a large resistance is generated, thus increasing the holding force for the recording paper. Thus, if the recording paper is strongly pulled for cutting, it will not be fed.

As shown in FIG. 8, since the recording paper is sharply bent and cut by the blade portion 18*a* of the paper cutter 18 which is located above the platen 37, a good cutting operation of the recording paper can be performed.

In the first embodiment described above, the platen 37 is moved obliquely backward, i.e., in a direction which crosses the paper supporting surface of the platen at an acute angle and which is away from the printing surface of the printing head. However, in a second embodiment to be described below, the platen is moved immediately backward, i.e., in a direction which is substantially perpendicular to the paper supporting surface of the platen and which is away from the printing surface of the printing head.

Figure 11:
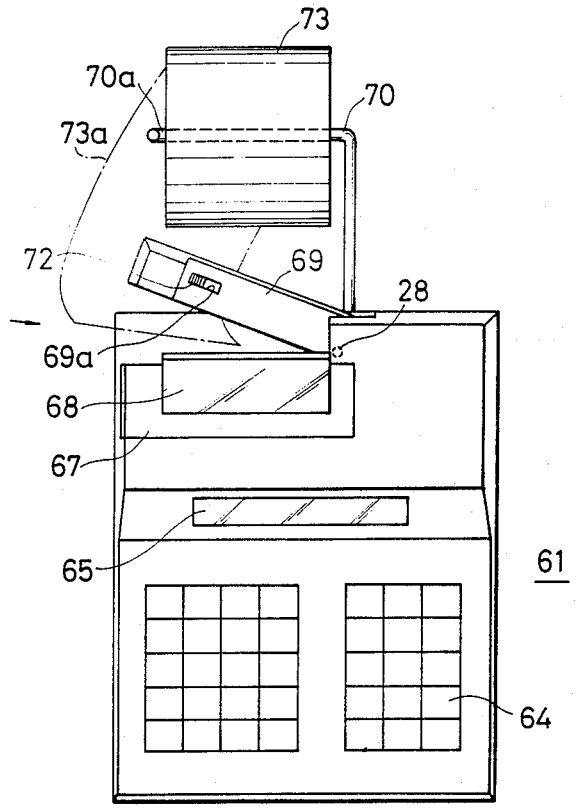
Figure 12:
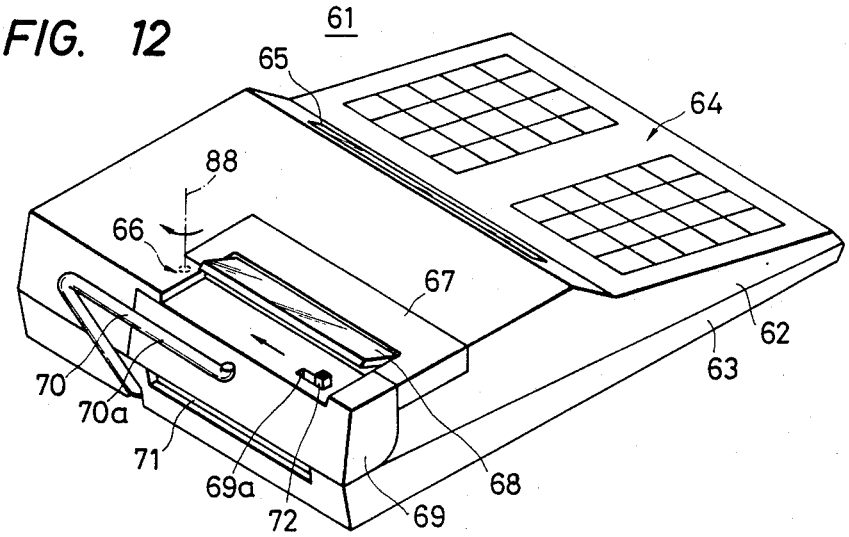

FIGS. 11 to 20 are provided for explaining the second embodiment of the present invention. FIGS. 11 and 12 show the outer appearance of the electronic calculator used as an example of the recording apparatus.

In FIGS. 11 and 12, an electronic calculator 61 comprises upper and lower casings 62 and 63. A keyboard section 64 is arranged on the front side of the upper casing 62, and a display section 65 comprising a liquid crystal display is arranged at substantially the central portion thereof.

A recording section 66 is arranged on the rear end portion of the electronic calculator 61, and incorporates a recording unit (to be described later). The recording section 66 is constituted by a lid 67, a paper cutter 68, a platen cover 69, and a roll paper holder 70, all of which are visible from the outside. A recording paper insertion port 71 is formed on the upper surface of the rear end of the lower casing 63.

A locking lever 72 of a platen (to be described later) projects from the upper surface of the platen cover 69 through an opening 69*a*.

The roll paper holder 70 is formed by bending a steel rod and the like, and has a horizontal arm 70*a* for axially supporting the roll paper 73.

Figure 13:
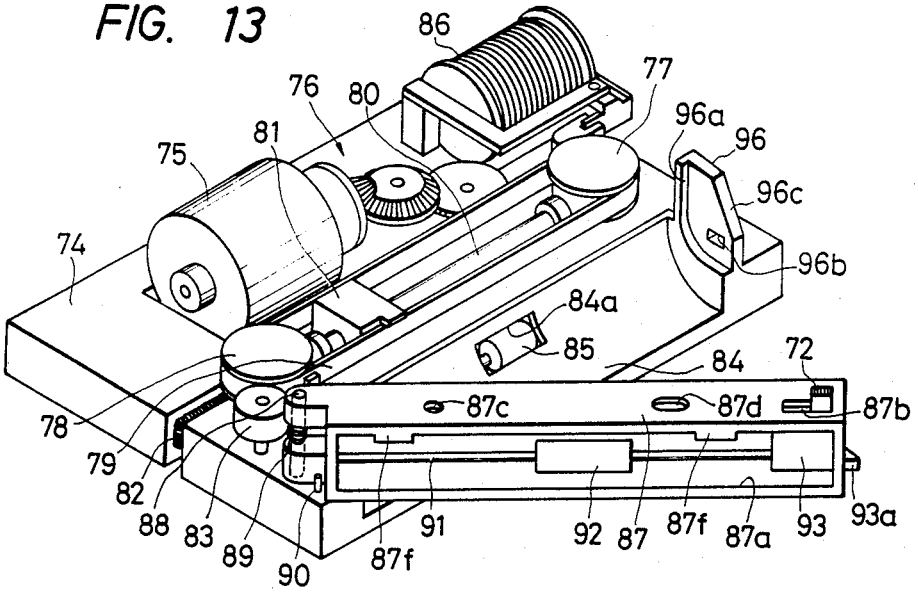
Figure 14:
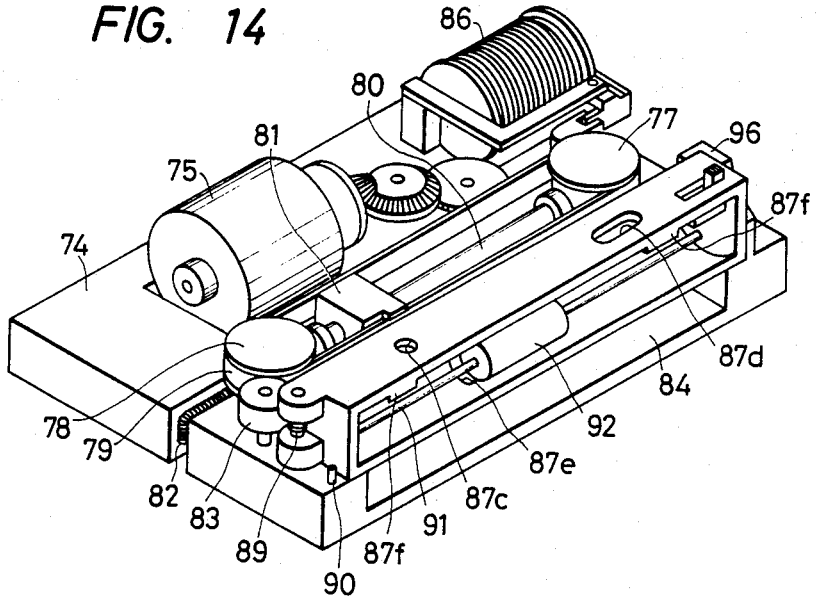

FIG. 13 shows the recording unit stored in the recording section 66 of the electronic calculator in detail.

Referring to FIG. 13, a motor 75 is arranged on the rear portion of a base 74. The rotation of the motor 75 is transmitted to a driving pulley 77 through gears 76.

A driven pulley 78 is arranged opposite to the driving pulley 77, and a font belt 79 is looped therebetween in an endless state.

Although not shown, fonts such as numerals and symbols are integrally formed on the outer peripheral surface of the font belt 79.

A carriage shaft 80 is arranged in an elongated space defined by the font belt 79. A carriage 81 incorporating a hammer (not shown) is movably mounted on the carriage shaft 80.

The recording unit includes a coil spring 82 for returning the carriage, an ink roller 83 for applying ink to the fonts on the font belt 79, and a solenoid 86 for stopping the font belt.

A recording paper guide portion 84 having an arcuate surface is arranged at the distal end side of the base 74 as shown in FIG. 13, and an opening 84*a* is formed in substantially the central portion of the guide portion 84 along the longitudinal direction thereof. A feed roller 85 faces the opening 84*a*.

The feed roller 85 is rotated by a driving mechanism (not shown).

A platen 87 maintains the position of the recording medium when a recording operation is performed by a recording means, and has a hollow frame structure. The surface of the platen 87 facing the guide portion 84 is curved in the same manner as that of the guide portion 84. The platen 87 has an opening 87*a* on the front side in FIG. 13.

One end of the platen 87 is pivotally supported by the base 74 through a supporting shaft 88. A torsion coil spring 89 is wound around the supporting shaft 88 to provide a clockwise (FIG. 13) pivotal force to the platen 87.

Thus, the platen 87 pivots in a backward direction parallel to the bottom surface of the lower casing 63, i.e., in a direction which is substantially perpendicular to the paper supporting surface R of the platen 87 and which is away from the printing surface 79*a* of the printing head.

The pivotal limit of the platen 87 is defined by a stopper 90 projecting from the base 74.

A pinch roller shaft 91 formed of a metal such as stainless steel, or an elastic member such as plastic is horizontally suspended in the opening 87*a* of the platen 87.

A pinch roller 92 which is brought into rolling contact with the feed roller 85 is rotatably supported at the central portion of the pinch roller shaft 91.

The locking lever 72 is mounted on the free end side of the platen 87.

Figure 15:
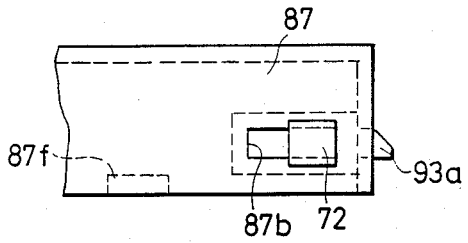
Figure 16:
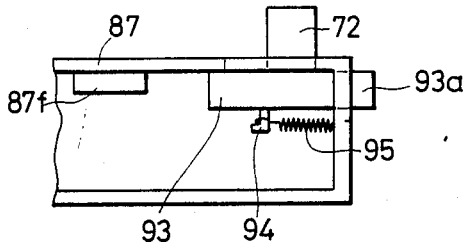
Figure 17:
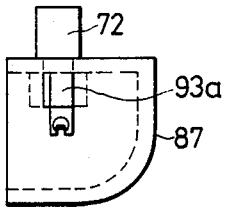

More specifically, as shown in FIGS. 15 to 17, an elongated hole 87*b* is formed in the upper surface of the platen 87 on the free end side along the longitudinal direction thereof. The locking lever 72 having a head portion larger than the width of the elongated hole 87*b* is fitted in the elongated hole 87*b* from the top.

The lower end of the locking lever 72 is fitted in a block 93 arranged below the elongated hole 87*b* through a shaft (not shown) having a diameter which is substantially the same width as that of the elongated hole 87*b*, as shown in FIGS. 15 to 17.

The block 43 is larger than the elongated hole 87*b*.

Therefore, the locking lever 72 and the block 93 are slidably arranged to sandwich the upper plate of the platen 87 therebetween.

A pawl 93*a* having an inclined surface at the side of the base 74 projects from the distal end of the block 93, and can slidably extend through the side wall of the platen 87 on the free end side.

A pin 94 projects from the lower surface of the block 93. A tension coil spring 95 is stretched between the pin 94 and the side wall of the platen 87 on the free end side to bias the locking lever 72 and the block 93 toward the right as shown in FIG. 13, thereby continuously projecting the pawl 93*a*.

On the side of the base 74, a side plate 96 vertically projects from the block 93 on the right side of the guide portion 84 as shown in FIG. 13.

A projection 96 defining the identical arcuate surface to that of the platen 87 is formed on the inner surface of the side plate 96, and a through hole 96*b* engaged with the pawl 93*a* is formed in the lower portion thereof.

An inclined surface 96*c* is formed on the corner portion of the distal end of the side plate 96. The inclined surface 96*c* is formed to widen a recording paper mounting path when the roll paper is mounted, as will be described later.

Therefore, when the locking lever 72 is pulled to disengage the pawl 93*a* from the through hole 96*b*, the platen 87 is opened by the force of the torsion coil spring 89.

When the platen 87 is pushed toward the base 74 against the force of the torsion coil spring 89, the inclined surface of the pawl 93*a* is pushed by the side plate 96. The block 93 is moved backward, and the pawl 93*a* is engaged with the through hole 96*b* due to the force of the tension coil spring 95, thereby locking the platen.

At this time, the pinch roller shaft 91 is flexed, and the pinch roller 92 is urged against the feed roller 85 to sandwich the recording paper therebetween through the opening 87*e* of the platen 87.

Note that the locking lever, the pawl, and the like may be formed on the base 74, and the through hole may be formed on the platen.

Figure 18:
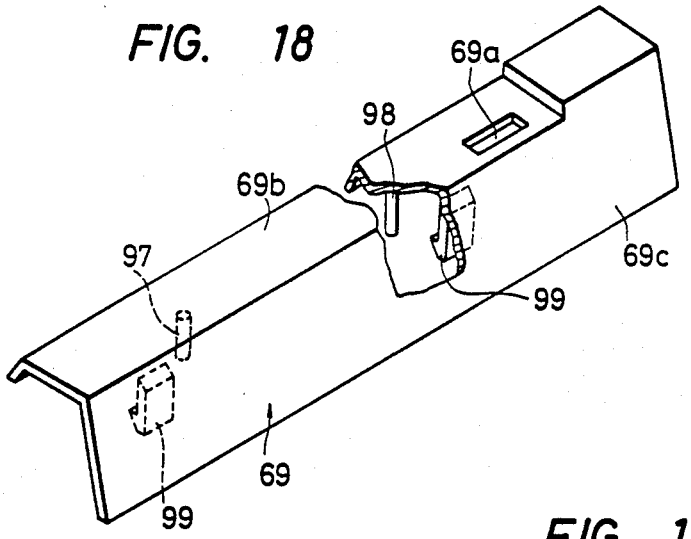

The platen cover 69 engaged with the platen 87 is arranged as shown in FIG. 18.

More specifically, the platen cover 69 has a roof-like shape to entirely cover the platen 87 and to constitute a portion of the outer appearance of the apparatus such as the electronic calculator. Positioning pins 97 and 98 which are respectively fitted in a small hole 87*c* and an elongated hole 87*d* formed on the upper surface of the platen 87 project from the lower surface of the upper surface of an upper plate 69*b*.

An elongated hole 69*a* engaged with the locking lever 72 is formed on one end side of the platen cover 69.

Locking pawls 99 are formed on the upper end portion of the inner surface of the side plate 69*c* of the platen cover 69 and are separated by a predetermined distance.

The locking pawls 99 are hooked by projections 87*f* projecting inside the opening from the upper plate of the platen 87.

Since the platen cover 69 adopts the structure as described above, the platen cover is moved downward while it is positioned above the platen 87, the positioning pins 97 and 98 are respectively fitted in the small and elongated holes 87*c* and 87*d*, and the locking pawls 99 are hooked by the projections 97*f* while being elastically deformed, so as to be fitted on the platen 87.

Figure 19:
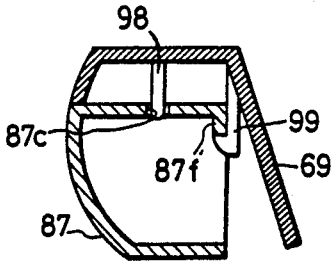

FIG. 19 shows this state.

The operation of this embodiment with the above arrangement will now be described.

When the recording paper is to be mounted, the locking lever 72 is pulled to the left as indicated by arrow in FIG. 12 from a state wherein the platen cover 69 is closed together with the platen 87. Then, the platen 87 and the platen cover 69 which are disengaged from each other by the force of the torsion coil spring 89 are pivoted clockwise in FIG. 11 about the supporting shaft 88 so as to be opened, and abut against the stopper 90, thus stopping at a predetermined opening angle, i.e., about 30°.

This opening angle is selected not to interfere with the operation of the roll paper 73 in consideration of its maximum diameter.

In this state, the roll paper 73 is mounted on the horizontal arm 70*a* of the roll paper holder 70.

The roll paper is mounted so that its one end 73*a* is unattached from the lower side.

One end 73*a* of the recording paper 73 is guided from the free end side of the opening platen, as shown in FIG. 11, and is overlaid on the guide portion 84. The recording paper is drawn by a predetermined length, and is positioned using the right and left side walls of the guide portion 84. In this state, the platen 87 is pivoted together with the platen cover 69 and they are pushed toward the electronic calculator.

Then, the pawl 93*a* retracts as described above, and the inner edge of the platen 87 on the free end side abuts against the projection 96*a* of the side plate 96 and is thereby stopped. The pawl 96*a* is engaged with the through hole 96*b* to be locked.

At this time, one end 73*a* of the roll paper is clamped between the feed roller 85 and the pinch roller 92.

The urging force at this time is determined by an elastic force of the pinch roller 91.

Figure 20:
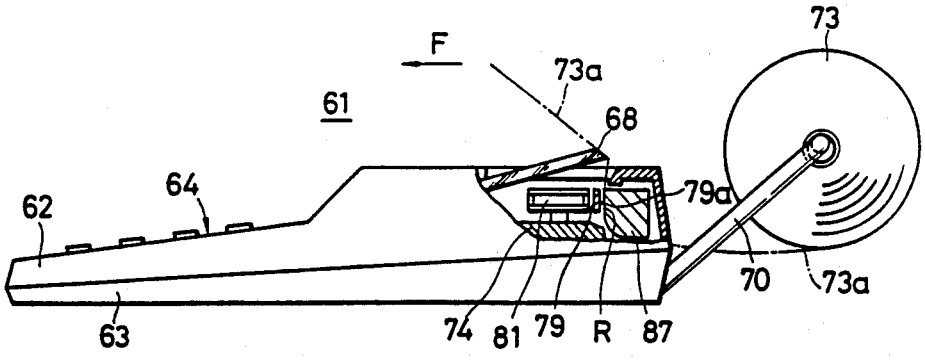

When the recording paper is mounted in this manner, one end 73*a* of the recording paper is moved upward along the platen 87, as shown in FIG. 20, and is then guided by the lower surface of the paper cutter 68 which is obliquely mounted. Thereafter, the recording paper is guided upward through a gap between the distal end of the paper cutter 68 and the platen cover 69.

A recording operation is performed upon operation of the keyboard section 64.

In order to facilitate pulling or returning of the recording paper by a user, the driving mechanism for the feed roller 85 is often separated from a driving system in the printing standby mode As a result, the recording sheet holding force of the recording unit is decreased.

When the recording sheet is to be cut, one end 73*a* of the recording paper abuts against the distal end of the paper cutter 68 and is drawn toward the front side of the electronic calculator as indicated by arrow F in FIG. 20. However, if the paper cutter 68 is arranged so that its distal end extends to a position behind the inner edge of the platen 87 and they overlap each other, the recording paper is strongly urged along the inner surface of the platen 87, and a large frictional resistance is generated, thus increasing the holding force for the recording paper. Even if the recording paper is pulled for cutting, the recording paper is not fed, and good cutting operation is allowed. Therefore, if the distal end of the paper cutter 68 and the inner edge of the platen 87 are arranged at positions to overlap each other, as shown in FIG. 20, the platen 87 is pivoted horizontally with respect to the electronic calculator, and will not interfere with the paper cutter 8.

FIGS. 21 to 31 show a third embodiment of the present invention. In this embodiment, a paper cutter slides and is interlocked with movement of a platen.

Figure 21:
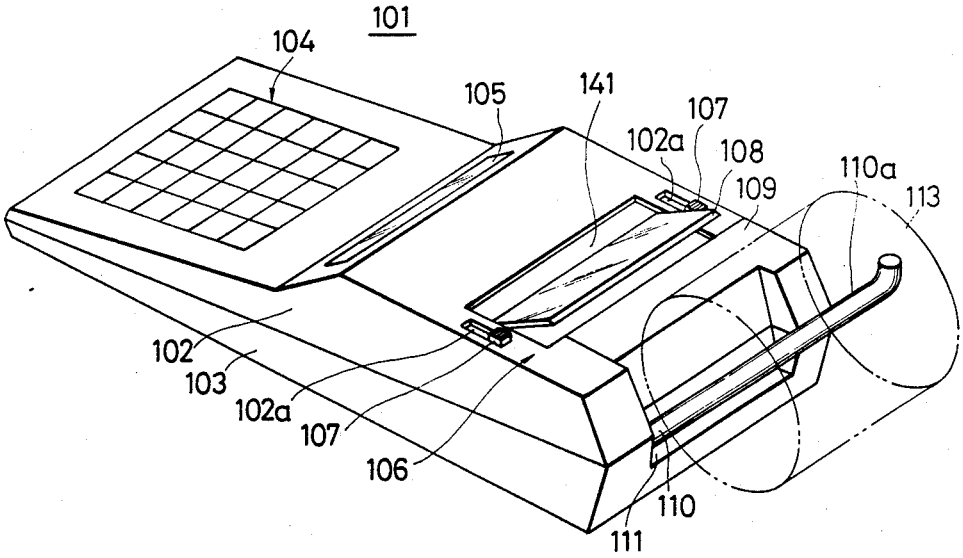

FIG. 21 shows the outer appearance of an electronic calculator as an example of a recording apparatus.

Referring to FIG. 21, an electronic calculator 101 comprises upper and lower casings 102 and 103. A keyboard section 104 is arranged on the front side of the upper casing 102, and a display section 105 using a liquid crystal display is arranged at substantially the central portion thereof.

A recording section 106 is arranged on the rear end portion of the electronic calculator 101, and incorporates a recording unit (to be described later). The recording section 106 is constituted by a paper cutter 108 having a structure to be described later, a platen cover 109, and a roll paper holder 110, all of which are visible from the outside. A recording paper insertion port 111 is formed below the platen cover 109.

The roll paper holder 110 is formed by bending a steel rod or the like and has a horizontal arm 110*a* for axially supporting roll paper 113. Actuating members 107 project from elongated holes 102*a* formed in the upper casing 102.

Figure 22:
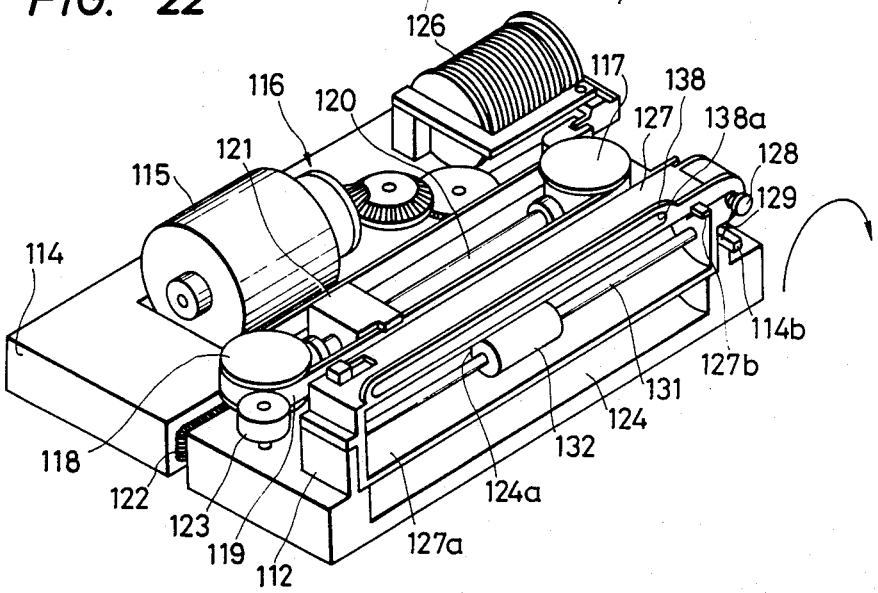

FIG. 22 shows in detail the recording unit stored in the recording section 106 of the electronic calculator 106.

Referring to FIG. 22, a motor 115 is arranged on a rear portion of a base 114, and the rotation of the motor 115 is transmitted to a driving pulley 117 through gears 116.

A driven pulley 118 is arranged opposite to the driving pulley 117, and a font belt 119 is looped therebetween in an endless state.

Figure 25:
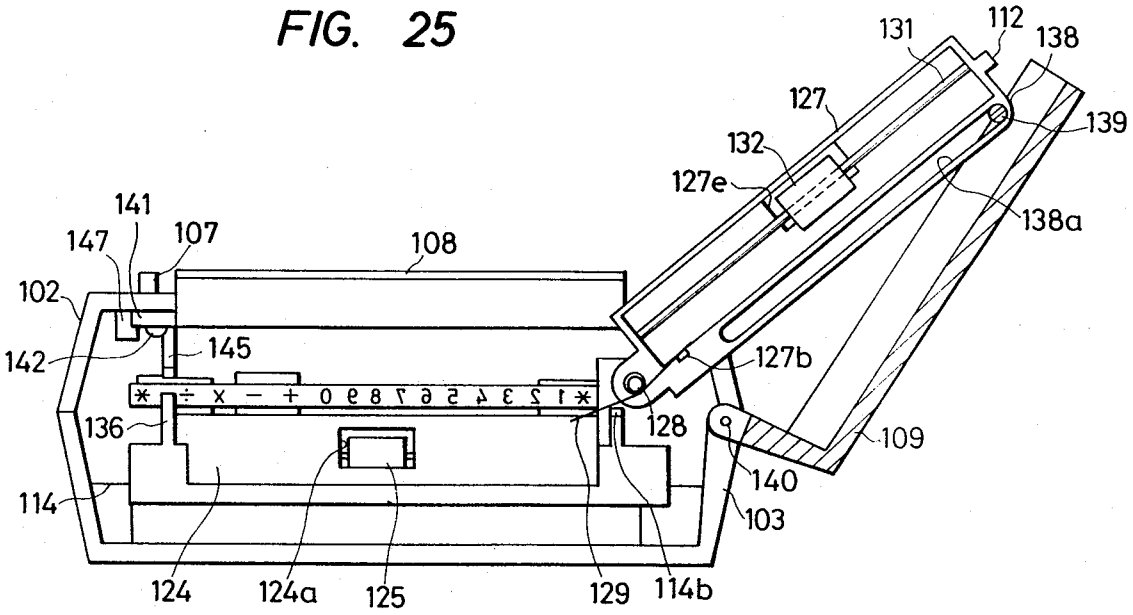
Figure 26:
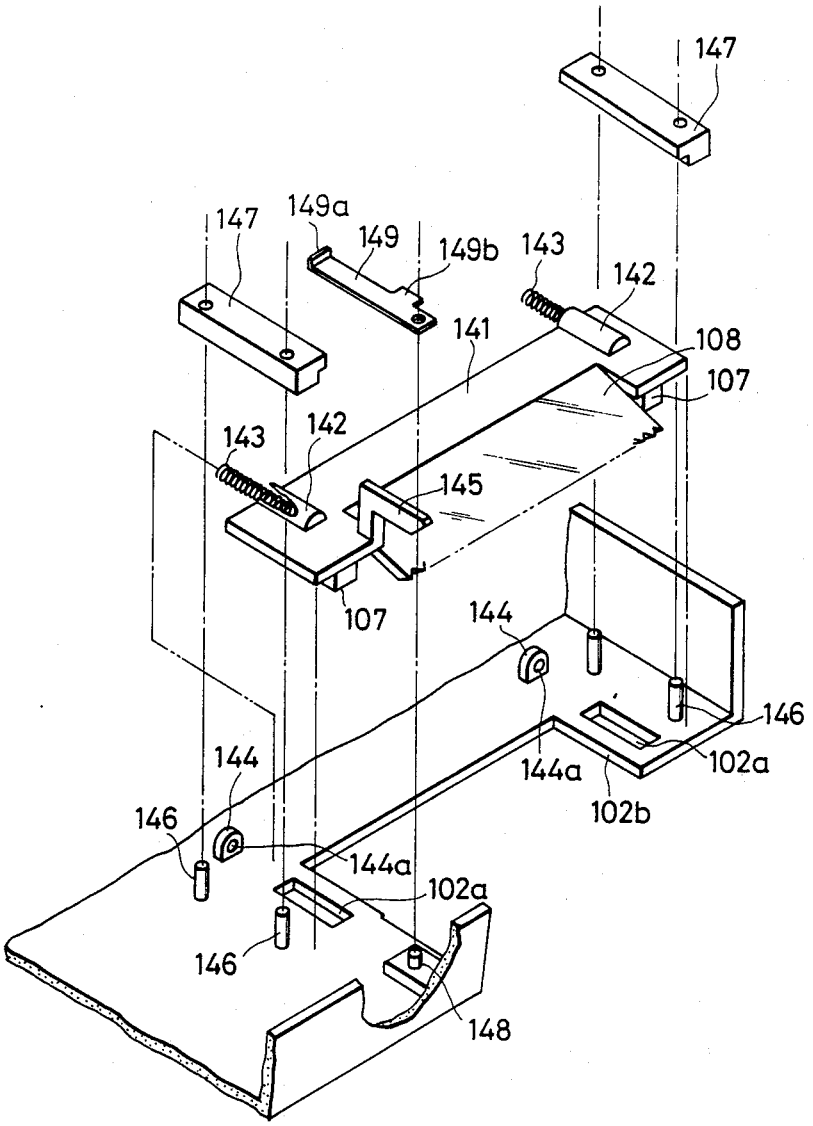
Figure 27:
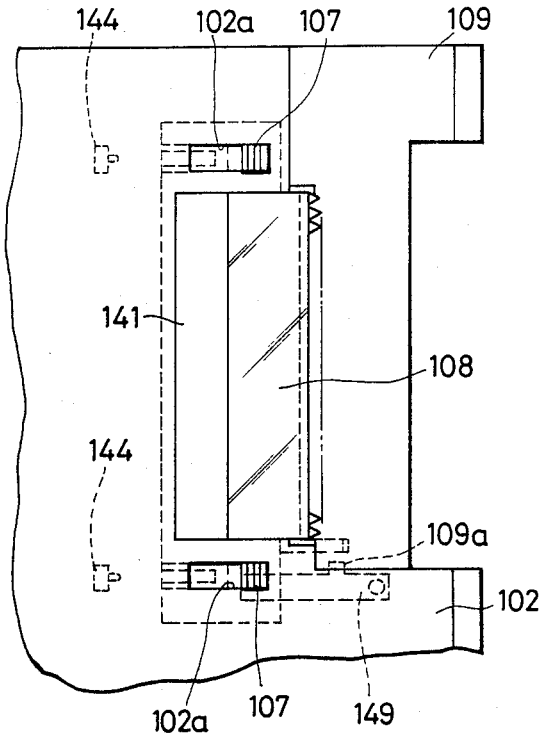

As shown in FIG. 25, fonts such as numerals and symbols are integrally formed on the outer peripheral surface of the font belt 119.

A carriage shaft 120 is arranged in an elongated space defined by the font belt 119. A carriage 121 incorporating a hammer (not shown) is movably mounted on the carriage shaft 120.

The recording unit includes a coil spring 122 for returning the carriage, an ink roller 123 for applying ink to the fonts on the font belt 119, and a solenoid 126 for stopping the font belt. The solenoid 126 also has a carry function.

A recording paper guide portion 124 having an arcuate surface is arranged on the distal end side of the base 114 as shown in FIG. 22. An opening **124*a* is formed in substantially the central portion of the guide portion 124 along the longitudinal direction thereof, as shown in FIG. 25. A feed roller 125 faces the opening 124*a***.

The feed roller 125 is rotated by a driving mechanism (not shown).

A platen 127 has basically a hollow frame structure, and its side surface at the side of the guide portion 124 is substantially identical to that of the guide portion 124 The platen 127 has an opening **127*a*** at the front side in FIG. 22.

One end of the platen 127 is supported by a supporting plate **114*a* on the base 114 through a supporting shaft 128 and can be pivoted upward. A torsion coil spring 119 is wound around the supporting shaft 128. One end of the coil spring 119 is engaged with a projection 114*b* of the supporting plate 114*a*, and the other end is engaged with a projection 127*b* of the platen 127, so that the coil spring 119 applies a clockwise (FIG. 22) pivotal force to the platen 127. The pivotal limit of the platen 127 is defined by the platen cover 109** (to be described later).

A pinch roller shaft 131 formed of a metal such as stainless steel, or an elastic member such as plastic is horizontally suspended in the opening **127*a* of the platen 127**.

A pinch roller 132 which is brought into rolling contact with the feed roller 125 is pivotally supported at the central portion of the pinch roller shaft 131.

Figure 23:
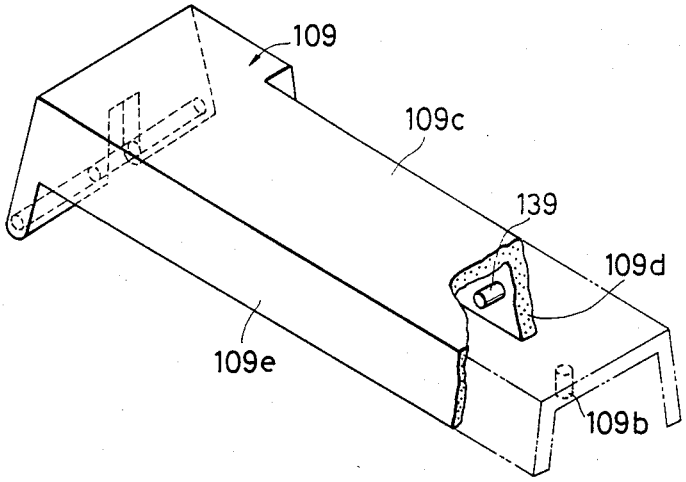
Figure 24:
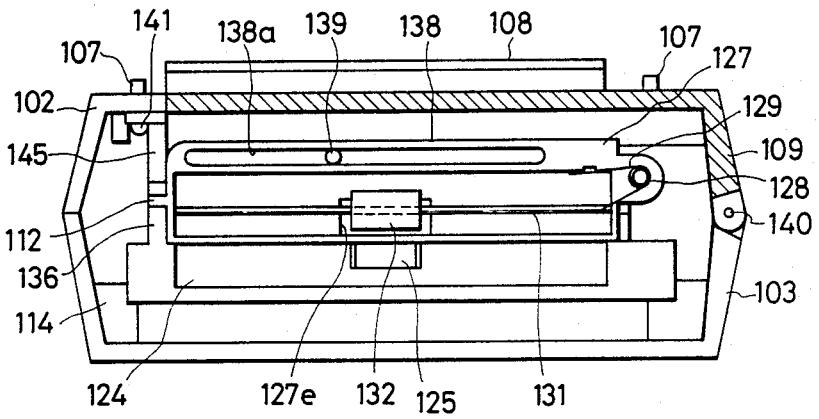

A platen cover 109 engaged with the platen 127 is arranged as shown in FIG. 23.

More specifically, the platen cover 109 has a roof-like shape so as to entirely cover the platen 127 and to constitute part of the outer appearance of the apparatus such as the electronic calculator. A projection **109*e* is formed on the side edge of the platen cover 109** on the side of the main body.

A pin 139 which is slidably fitted in an elongated hole **138*a* of the platen 127 projects from the inner surface of a side plate 109*d* of the platen cover 109, which is located on the rear portion of the electronic calculator 101**.

One end of the platen cover 109 having the above arrangement is pivotally supported on the lower casing 103 through a shaft 140 outside the supporting shaft 128, as shown in FIG. 25.

In this embodiment, the paper cutter 108 is slidable through the actuating members 107. FIGS. 26 to 30 show the structure of the paper cutter 108.

More specifically, the paper cutter 108 which is inclined upward is located in the notch **102*b* of the upper casing 102 on the side of the recording section. The paper cutter 108 is formed integrally with a slide plate 141 which is arranged below the upper casing 102 and which is larger than the notch 102*b***.

The actuating members 107 integrally project from the slide plate 141, and are slidably fitted in the elongated holes **102*a*, which are formed on two sides of the notch 102*b*** and extend in a back-and-forth direction.

Cylindrical portions 142 are formed on two sides of the back surface of the slide plate 141. Each cylindrical portion 142 has an open end on the front side of the electronic calculator, and one end of each of coil springs 143 is fitted in the cylindrical portion 142.

The other end of each coil spring 143 is supported by a corresponding projection **144*a* of an abutment 114 projecting from the lower surface of the upper casing 102, thus biasing the slide plate 141 toward the platen 127**.

The biasing force of each coil spring 143 is set to be larger than a force applied upon cutting of the recording paper, and the cutter does not move at that time.

An L-shaped arm 145 bent toward the platen 127 is integrally formed on the lower surface of the slide plate 141.

The arm 145 is brought into contact with the upper side of a projection 112 projecting from the side surface of the platen 127 on the free end side, and has as its function the locking of the platen 127.

The slide plate 141 having the above structure is slidably guided by stepped guide members 147 fixed by welding to pins 146 projecting from the two sides of the notch **102*b***.

One end of a leaf spring 149 is fixed through a projection 148 to the lower surface of the upper casing 102 extending outside the platen 127 on the free end side.

A bent portion **149*a* is formed on the free end of the leaf spring 149** to be inclined downward.

A projection **149*b* projecting toward the platen 127 is formed midway along the leaf spring 149. The projection 149*b* is located at a position corresponding to the projection 109*b* projecting from the lower surface cf the platen cover 109** on the free end side.

The operation of this embodiment having the above arrangement will now be described.

More specifically, in a state wherein the platen 127 is closed and the slide plate 141 is moved forward by the spring 143, the paper cutter 108 and the actuating members 107 are moved forward toward the platen 127, and the actuating members 107 are brought into contact with the edges of the corresponding elongated holes **102*a* on the side of the platen 127**, thereby restricting their movement.

In this state, the arm 145 is brought into contact with the upper side of the projection 112 on the free end side of the platen 127 to lock it.

Figure 28:
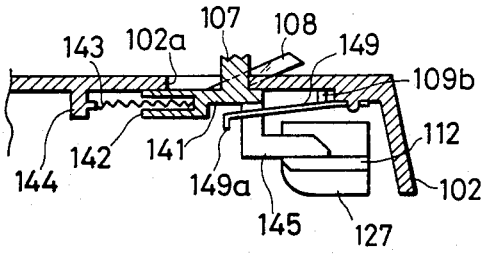

The projection **109*b* is brought into contact with the projection 149*b* of the leaf spring 149 to press the leaf spring 149 Thus, the leaf spring 149 is elastically deformed downward as shown in FIG. 28, and will not be brought into contact with the slide plate 141**.

Figure 29:
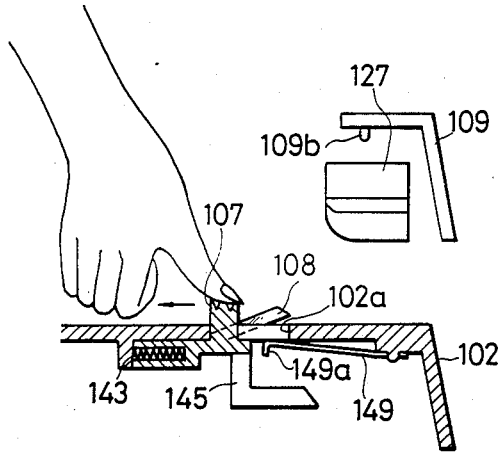
Figure 30:
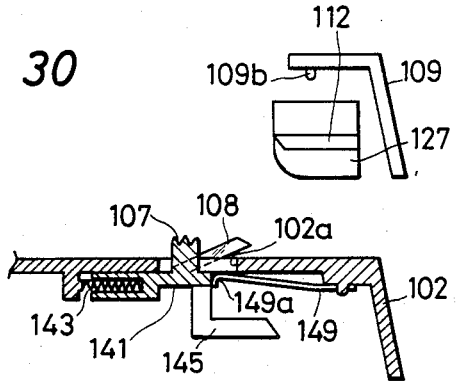

When the recording paper is to be set, a finger tip is urged against the corresponding actuating member 107 and pulls it as shown in FIG. 29. Then, the slide plate 141 is moved toward the front side of the electronic calculator while being biased by the coil spring 143, and the paper cutter 108 is accordingly moved.

Therefore, the paper cutter 108 is moved to a position at which it does not interfere with the platen 127.

The moving limit of the slide plate 141 toward the front side of the calculator is defined such that the actuating members 107 are brought into contact with the edge portions of the corresponding elongated holes 102*a* on the front side of the calculator.

Upon movement of the slide plate 141, the arm 145 is also moved toward the front side of the electronic calculator, add is disengaged from the projection 112 of the platen 127. Thus, the platen 127 is opened due to the force of the torsion coil spring 129, as shown in FIG. 25.

At the same time, the platen cover 109 is also opened, and the pin 139 is moved in the elongated hole 138*a* until it abuts against the edge portion thereof on the free end side of the platen 127, and is held in position.

In this state, the roll paper 113 is mounted on the roll paper holder 110, so that its one end 113*a* is unattached from the lower side of the recording paper.

One end 113*a* of the recording paper is positioned using two side walls of the guide portion 124, and guided upward from the paper supporting surface R (FIG. 31) so that it passes from the lower surface of the platen 127 via its inner surface.

When the recording paper is to be set, the platen 127 is pivoted together with the platen cover 109. Thus, the projection 109*b* is separated from the leaf spring 149, and the free end side of the leaf spring 149 is deformed upward by its elastic force.

Then, the bent portion 149*a* on the free end side of the leaf spring 149 faces the distal end of the slide plate 141.

Therefore, if the finger tip is released from the corresponding actuating member 107, the slide plate 141 is slightly moved forward by the elastic force of the coil spring 143 and is brought into contact with the bent portion 149*a*, thereby restricting movement of the slide plate 141 and the paper cutter 108.

The recording paper is set as described above.

After the recording paper is set, the platen 127 is pivoted counterclockwise as shown in FIG. 25 through the platen cover 109.

Since the projection 109*b* of the platen cover 109 pushes the projection 149*b* of the leaf spring 149, the free end side of the leaf spring 149 is elastically deformed downward, and the bent portion 149*a* is separated from the distal end of the slide plate 141.

As a result, the slide plate 141 is moved toward the platen 127 together with the paper cutter 108 by the force of the coil spring 143.

At this time, the projection 112 of the platen 127 is located below the arm 145. Thus, upon movement of the arm 145, the projection 112 is engaged with the arm 145, as shown in FIG. 28, thereby locking the platen 127 and the platen cover 109 interlocked therewith.

In this state, a recording operation is performed by operating the keyboard section 104.

Figure 31:
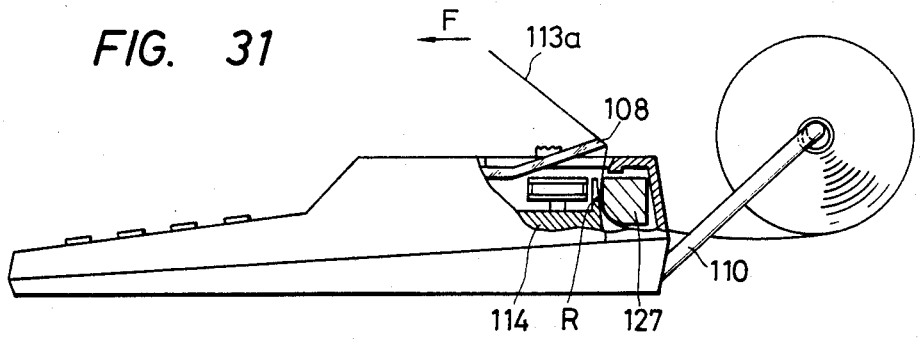

When the recording paper is to be cut, one end 113*a* of the recording paper is guided along the platen 127, as shown in FIG. 31. Thereafter, one end 113*a* of the recording paper is brought into contact with the knife edge portion of the paper cutter 108 and is drawn toward the front side of the electronic calculator by a predetermined force, as indicated by arrow F.

At this time, one end 113*a* of the recording paper is strongly urged against the inner peripheral surface of the platen 127, and is steeply bent by the knife edge portion. Thus, a large frictional force is generated, and the end 113*a* is strongly caught by the knife edge portion, thereby performing a good cutting operation.

FIGS. 32 to 42 show a fourth embodiment of the present invention. In this embodiment, a paper cutter is pivoted and interlocked with a platen.

Figure 32:
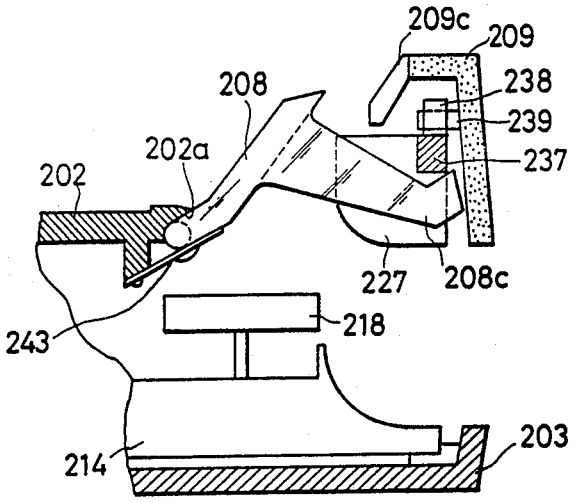
Figure 33:
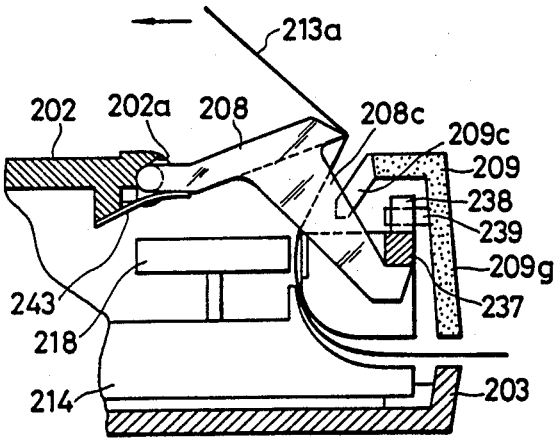
Figure 34:
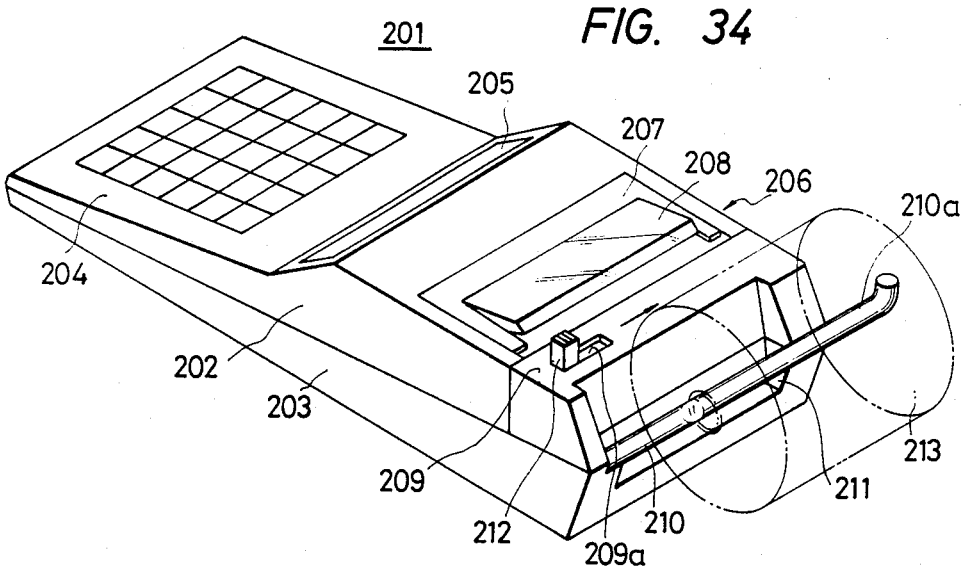

FIGS. 32 to 42 are provided for explaining the fourth embodiment of the present invention. FIG. 34 shows the outer appearance of an electronic calculator as an example of a recording apparatus.

Referring to FIG. 34, an electronic calculator 201 comprises upper and lower casings 202 and 203. A keyboard section 204 is arranged on the front side of the upper casing 202, and a display section 205 using a liquid crystal display is arranged at substantially the central portion thereof.

A recording section 206 is arranged on the rear end portion of the electronic calculator 201 and incorporates a recording unit (to be described later). The recording section 206 is constituted by a lid 207 for covering the recording section 206, a paper cutter 208, a platen cover 209, and a roll paper holder 210, all of which can be observed from the outside A recording paper insertion port 211 is formed below the platen cover 209.

A locking lever 212 (to be described later) projects from the upper surface of the platen cover 209 through an opening 209*a*.

The roll paper holder 210 is formed by bending a steel rod or the like, and has a horizontal arm 210*a* for supporting the roll paper 213.

Figure 35:
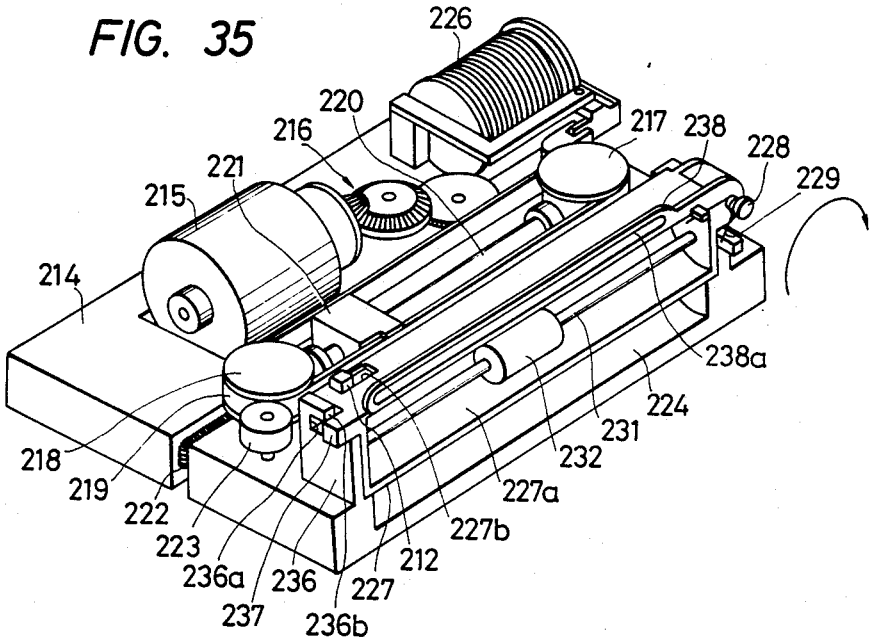

FIG. 35 shows in detail the recording unit stored in the recording section 206.

Referring to FIG. 35, a motor 215 is arranged on a rear portion of a base 214, and the rotation of the motor 215 is transmitted to a driving pulley 217 through gears 216.

A driven pulley 218 is arranged opposite to the driving pulley 217, and a font belt 219 is looped therebetween in an endless state.

Figure 38:
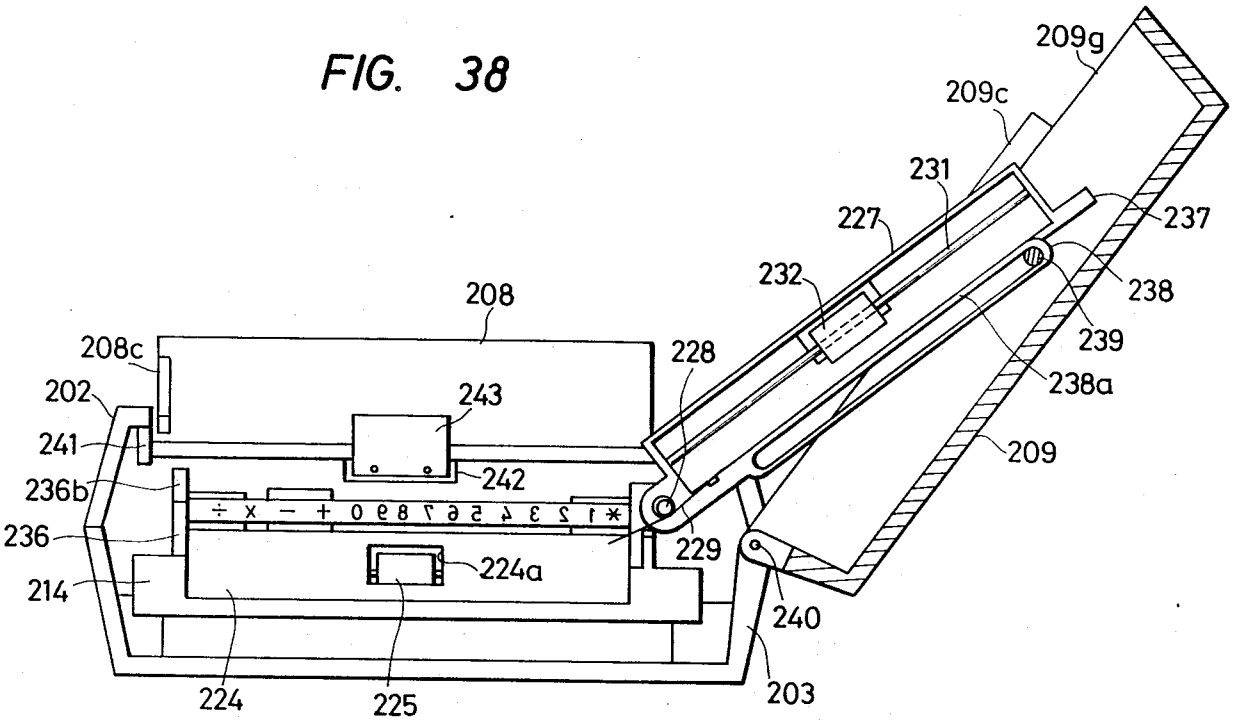

As shown in FIG. 38, fonts such as numerals and symbols are integrally formed on the outer peripheral surface of the font belt 219.

A carriage shaft 220 is arranged in an elongated space defined by the font belt 219. A carriage 221 incorporating a hammer (not shown) is movably mounted on the carriage shaft 220.

The recording unit also includes a coil spring 222 for returning the carriage, an ink roller 223 for applying ink to the fonts on the font belt 219, and a solenoid 226 for stopping the font belt 219.

Figure 37:
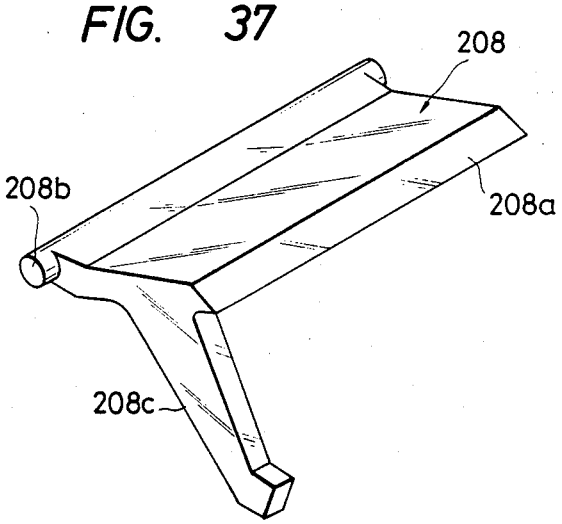

A recording paper guide portion 224 having an arcuate surface is formed on the distal end of the base 214 as shown in FIG. 35. An opening 224*a* is formed in substantially the central portion of the guide portion 224 along the longitudinal direction thereof. A feed roller 225 is located in the opening 224*a* (FIG. 37).

The feed roller 225 is rotated by a driving mechanism (not shown).

A platen 227 has basically a hollow frame structure, and its side surface at the side of the guide portion 224 is substantially identical to that of the guide portion 224.

The platen 227 also has an opening 227*a* at the front side in FIG. 35.

One end of the platen 227 is pivotally supported on the base 214 through a supporting shaft 228. A torsion coil spring 229 is wound around the supporting shaft 228 and biases the platen 227 clockwise (upward) in FIG. 35. The pivotal limit of the platen 227 is defined by the platen cover 209 (to be described later).

A pinch roller shaft 231 formed of a metal such as stainless steel, or plastic is horizontally suspended in the opening 227*a* of the platen 227.

A pinch roller 232 which is brought into rolling contact with the feed roller 225 is pivotally supported at the central portion of the pinch roller shaft 231.

The locking lever 212 as described above is mounted on the free end side of the platen 227.

Figure 39:
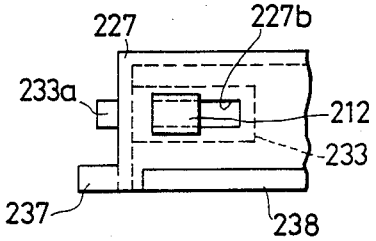
Figure 40:
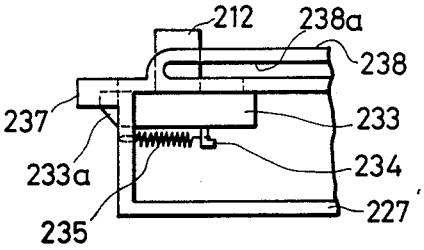
Figure 41:
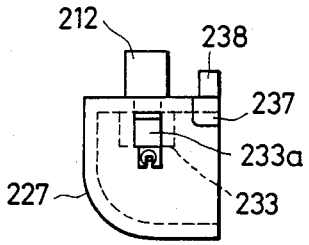

More specifically, as shown in FIGS. 39 to 41, an elongated hole 227*b* is formed in the upper surface of the platen 227 on the free end side along the longitudinal direction thereof, so that the locking lever 212 having a head portion larger than the width of the elongated hole 227*b* is fitted in the elongated hole 227*b* from the top.

The lower end of the locking lever 212 is fitted in a block 233 arranged below the elongated hole 227*b* through a shaft (not shown) having a diameter which is substantially the same as the width of the elongated hole 227*b*, as shown in FIGS. 39 to 41.

The block 233 is larger than the elongated hole 227*b*. Therefore, the locking lever 212 and the block 233 are slidably arranged to sandwich the upper plate of the platen 227 therebetween.

A pawl 233*a* having an inclined surface on the side of the base 214 (lower side) projects from the distal end of the block 233. The pawl 233*a* can slidably extend through the side wall of the platen 227 on the free end side.

A pin 234 projects from the lower surface of the block 233. A tension coil spring 235 extends between the pin 234 and the side wall of the platen 227 on the free end side so as to bias the locking lever 212 and the block 233 to the left as shown in FIG. 34, thereby continuously projecting the pawl 233*a*.

On the side of the base 214, a side plate 236 vertically projects at the right end of the guide portion 224 in FIG. 35. An opening or through hole 236*a* which can be engaged with the pawl 233*a* is formed in the side plate 236, and a notch 236*b* is formed in the corner portion on the front side in FIG. 35. A projection 237 projecting from the free end portion of the platen 227 is fitted in the notch 236*b* to be positioned thereby.

Therefore, when the locking lever 212 is pulled to disengage the pawl 233*a* from the through hole 236*a*, the platen 227 can be opened by the force of the torsion spring 229.

When the platen 227 is pushed toward the base 214 against the force of the torsion coil spring 229, the inclined surface of the pawl 233*a* is pushed by the side plate 236, and the block 233 is moved backward. Then, the pawl 233*a* is engaged with the through hole 236*a* by the force of the tension coil spring 235, thereby locking the platen.

At this time, the pinch roller shaft 231 is flexed and the pinch roller 232 is urged against the feed roller 225 to sandwich the recording paper therebetween through an opening 227*e* of the platen 227.

Note that the locking lever, the pawl, and the like may be arranged on the base 214, and the through hole may be formed in the platen.

A projection 238 is formed on the upper end portion of the platen 227 on the front side in FIG. 35, and an elongated hole 238*a* is formed in the projection 238 along the longitudinal direction thereof.

Figure 36:
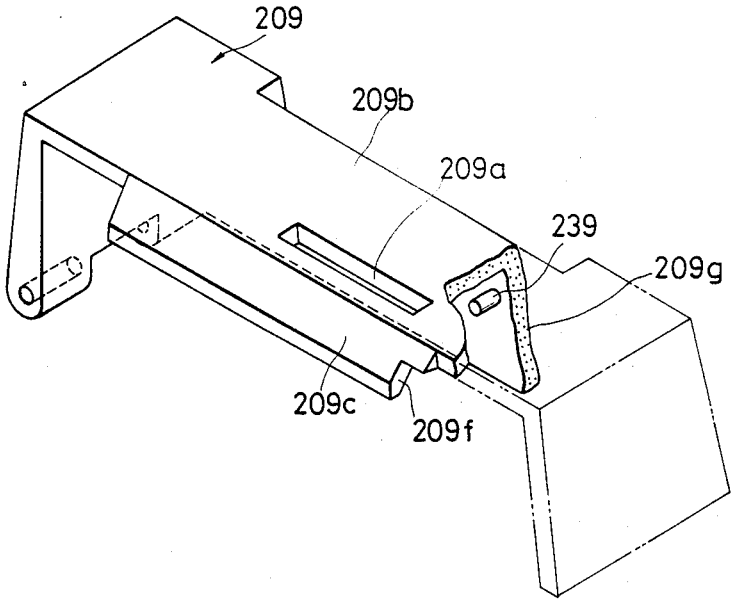

The platen cover 209 engaged with the platen 227 is arranged as shown in FIG. 36.

More specifically, the platen cover 209 has a roof-like shape so as to entirely cover the platen 227 and to constitute part of the outer appearance of the recording apparatus such as the electronic calculator. An elongated hole 209*a* in which the locking lever 212 is fitted is formed in an upper plate 209*b* of the platen cover 209. A projection 209*c* projecting downward is formed on the side edge of the upper plate 209*b* on the main body side (inside) of the electronic calculator. A notch 209*f* for escaping an arm of the paper cutter (to be described later) is formed in the one end of the projection 209*c*.

A pin 239 which is slidably fitted in the elongated hole 238*a* of the platen 227 projects from the inner surface of a side plate 209*g* of the platen cover 209 which is located on the rear portion of the electronic calculator 201.

One end of the platen cover 209 having the above structure is pivotally supported by the lower case 203 through a shaft 240 outside the supporting shaft 228 of the platen 227, as shown in FIG. 37.

The paper cutter 208 has a rectangular shape. A knife edge portion 208*a* is formed on one side edge of the cutter 208 along the widthwise direction thereof, and a supporting shaft 208*b* is integrally formed on the outer side edge thereof.

An arm 208*c* projects obliquely downward toward the rear portion of the electronic calculator from one side edge of the paper cutter 208 along the longitudinal direction thereof.

Two ends of the supporting shaft 208*b* of the paper cutter 208 are pivotally supported by bearings 241 arranged inside the upper casing 202, as shown in FIG. 37.

One end of a leaf spring 243 is fixed to the lower central portion of the supporting shaft 208*b* through a projection of the upper case 202. The free end of the leaf spring 243 is in contact with the lower side of the base portion of the paper cutter 208. Therefore, the paper cutter 208 is pivotally biased in a direction along which the knife edge portion 208*a* is moved upward. The pivotal movement of the cutter 208 is restricted by a stopper 202*a* formed on the opening edge of the upper casing 202, as shown in FIG. 33.

The arm 208*c* of the paper cutter 208 is mounted so that its distal end is located below a projection 237 of the platen 227.

The operation of this embodiment having the above arrangement will now be described.

When the recording paper is to be mounted, the locking lever 212 is pulled to the right as indicated by arrow in FIG. 34 from a state wherein the platen cover 209 is closed together with the platen 227. Then, the platen 227 and the platen cover 209 are disengaged from each other by the force of the torsion coil spring 229, pivoted clockwise in FIG. 37 about the supporting shaft 228, and opened.

At this time, the platen 227 and the platen cover 209 are respectively pivoted about the individual shafts 229 and 240, and have different pivoting paths. However, the difference therebetween is absorbed since the pin 239 is moved in the elongated hole 239*a*, and the platen 227 and the platen cover 209 are pivoted to be interlocked with each other.

The projection 237 of the platen 227 is separated from the upper side of the distal end of the arm 208*c* of the paper cutter 208 Then, the paper cutter 208 begins to be opened by the force of the leaf spring 243 from the state of FIG. 33, as shown in FIG. 32. Therefore, the paper cutter 208 will not interfere with the platen 227.

Note that the pivotal limit of the platen 227 and the platen cover 209 corresponds to a position at which the pin 239 reaches the distal end of the elongated hole 238*a*, as shown in FIG. 37.

In this state, the roll paper 213 is mounted on the horizontal arm 210*a* of the roll paper holder 210.

In this case, the roll paper 213 is mounted so that its one end 213*a* is unattached from the lower side.

One end 213*a* of the recording paper is guided from the side of the open platen 207 and is overlaid on the guide portion 224. Then, the recording paper is drawn by a predetermined length and is positioned using the two side walls of the guide portion 224. In this state, when the platen 227 is pivoted together with the platen cover 209 and they are pushed toward the electronic calculator, they are closed to be interlocked with each other, and the pawl 233*a* abuts against the side plate 236.

The pawl 233*a* then retracts as described above, and is engaged with the opening 236*a* to be locked thereby.

At this time, the projection 237 of the platen 27 is brought into contact with the upper side of the distal end of the arm 208*c* of the paper cutter 208, so that the paper cutter 208 is closed while flexing the leaf spring 243 and is held in position (FIG. 33).

At this time, one end 213*a* of the recording paper is clamped between the feed roller 225 and the pinch roller 232. The urging force at this time is determined by the elastic force of the pinch roller shaft 231.

Figure 42:
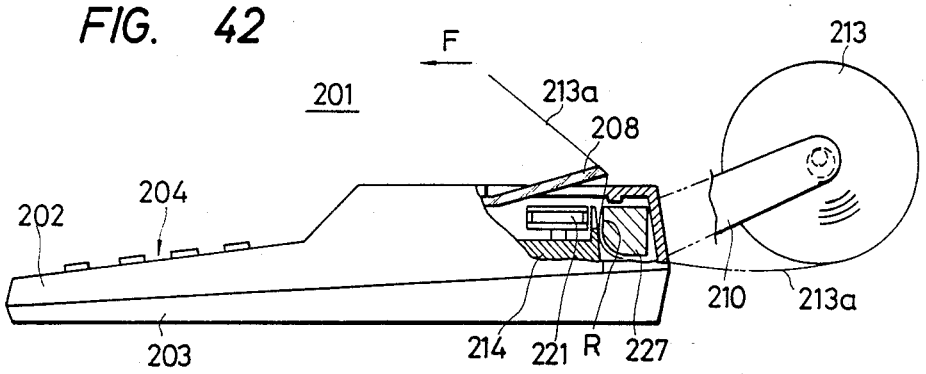

When the recording paper is mounted in this manner, since one end 213*a* of the recording paper is curled, it passes through a gap between the distal end of the paper cutter 208 and the platen cover 209 along the platen 227, i.e., projects upward from the paper supporting surface R of the platen 227, as shown in FIG. 42.

A recording operation is performed in this state by operating the keyboard section 204.

When the recording paper is cut, one end 213*a* of the recording paper abuts against the distal end of the paper cutter 208 as shown in FIG. 42, and is drawn toward the front side of the electronic calculator, as indicated by arrow F.

Since the paper cutter 208 is located at a position beyond the inner surface of the platen 227, the recording paper is strongly urged against the inner surface of the platen 227, and a large resistance is generated, thereby increasing the recording paper holding force. Even if the recording paper is strongly pulled for cutting, the recording paper is not fed, and a good cutting operation by the paper cutter 208 can be performed.

When the recording paper is cut, it abuts against the distal end of the paper cutter 208 and is abruptly bent toward the front side of the recording apparatus. Therefore, the recording paper is strongly caught by the knife edge portion of the paper cutter 208, and can be sharply cut thereby.

FIGS. 43 to 52 show a fifth embodiment of the present invention. In this embodiment, a roll paper holder is moved together with a platen.

Figure 43:
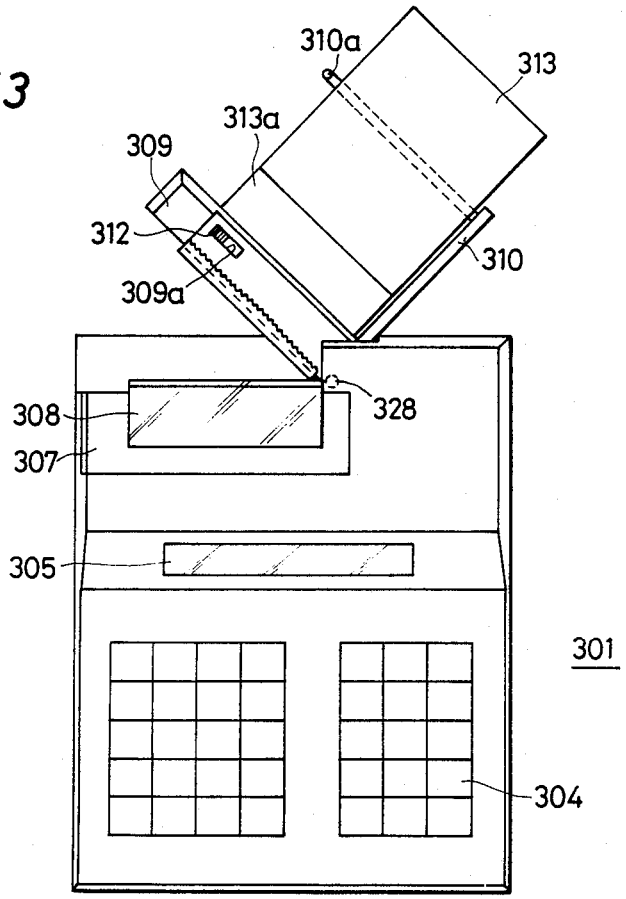
Figure 44:
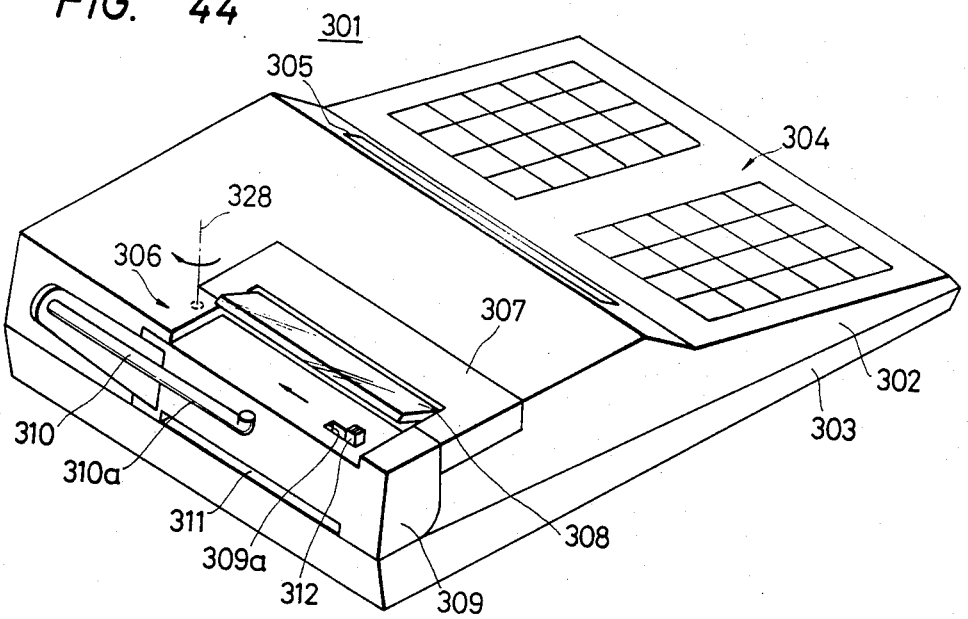

FIGS. 43 and 44 show the outer appearance of an electronic calculator as an example of the recording apparatus.

Referring to FIGS. 43 and 44, an electronic calculator 301 comprises upper and lower casings 302 and 303. A keyboard section 304 is arranged on the front side of the upper casing 302, and a display section 305 using a liquid crystal display is arranged at substantially the central portion thereof.

A recording section 306 is arranged on the rear end portion of the electronic calculator 301, and incorporates a recording unit (to be described later). The recording section 306 is constituted by a lid 307 for covering the recording section 306, a paper cutter 308, a platen cover 309, and a roll paper holder 310, all of which are visible from the outside. A recording paper insertion port 311 is formed below the platen cover 309.

A locking lever 312 (to be described later) projects from the upper surface of the platen cover 309 through an opening 309*a*.

The roll paper holder 310 is provided integrally with the platen cover 309, and has a horizontal arm 310*a* for supporting the roll paper 313.

Figure 45:
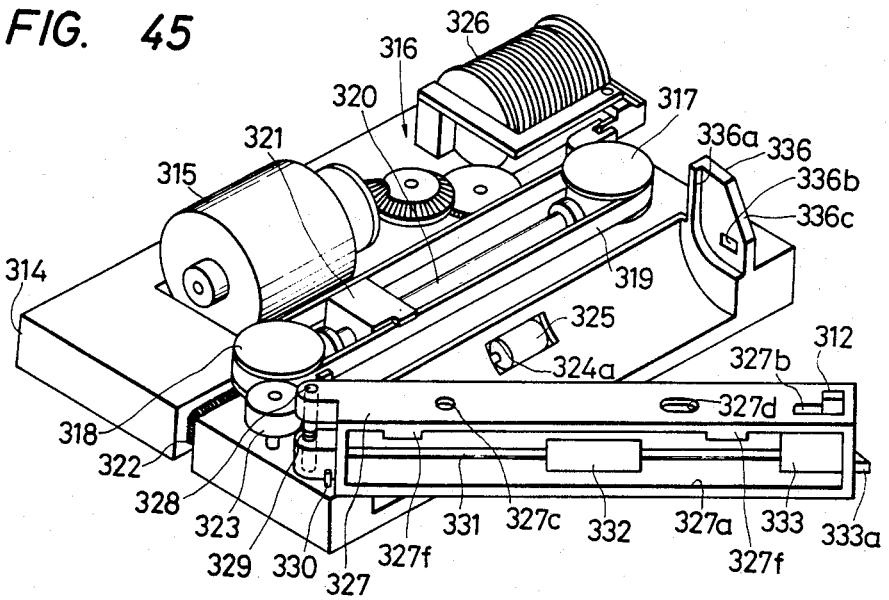
Figure 46:
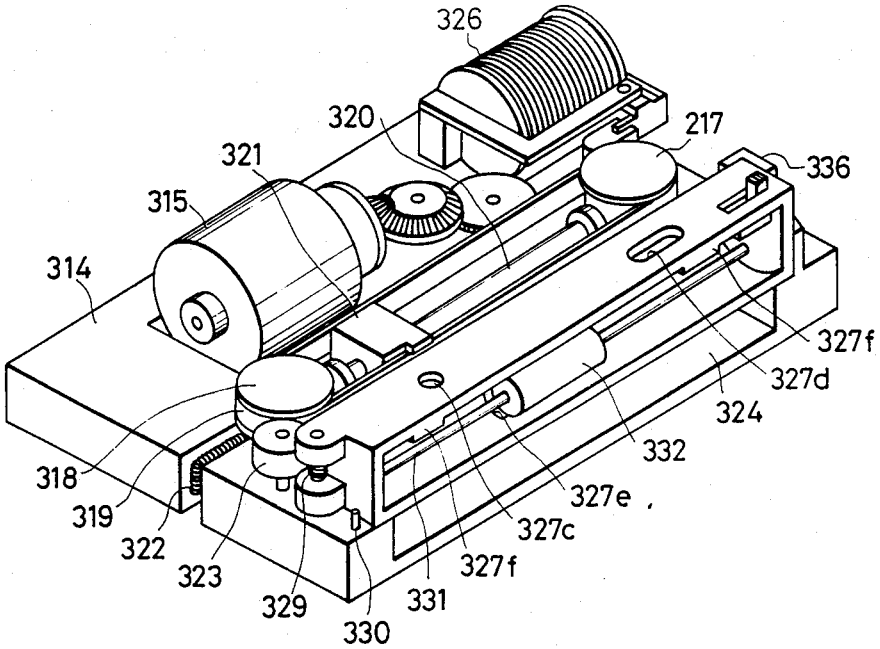

FIG. 45 shows in detail the recording unit accommodated in the recording section 306 of the electronic calculator.

Referring to FIG. 45, a motor 315 is arranged on a rear portion of a base 314, and the rotation of the motor 315 is transmitted to a driving pulley 317 through gears 316.

A driven pulley 318 is arranged opposite to the driving pulley 317, and a font belt 319 is looped therebetween in an endless state.

Although not shown, fonts such as numerals and symbols are integrally formed on the outer peripheral surface of the font belt 319.

A carriage shaft 320 is arranged in an elongated space defined by the font belt 319. A carriage 321 incorporating a hammer (not shown) is movably mounted on the carriage shaft 320.

The recording unit also includes a coil spring 322 for returning the carriage, an ink roller 323 for applying ink to the fonts on the font belt 319, and a solenoid 326 for stopping the font belt 319.

A recording paper guide portion 324 having an arcuate surface is arranged at the distal end of the base 314 in FIG. 45, and an opening 324*a* is formed in substantially the central portion of the guide portion 324 along the longitudinal direction thereof. A feed roller 325 is located in the opening 324*a*.

The feed roller 325 is rotated by a driving mechanism (not shown).

A platen 327 maintains the position of a recording medium when a recording operation is performed by a recording means, and has basically a hollow frame structure. A side surface of the platen 327 on the side of the guide portion 324 is substantially identical to that of the guide portion 324. The platen 327 has an opening 327*a* on the front side as shown in FIG. 45.

One end of the platen 327 is pivotally supported on the base 314 through a supporting shaft 328 as a holding member. A torsion coil spring 329 is wound around the supporting shaft 328 and biases the platen 327 clockwise in FIG. 45.

The pivotal movement of the platen 327 is restricted by a stopper 330 which projects on the base 314.

A pinch roller shaft 331 formed of a metal such as stainless steel, or an elastic member such as plastic is horizontally suspended in the opening 327*a* of the platen 327.

A pinch roller 332 which is brought into rolling contact with the feed roller 325 is pivotally supported at the central portion of the pinch roller shaft 331.

The locking lever 312 described above is mounted on the free end side of the platen 327.

Figure 47:
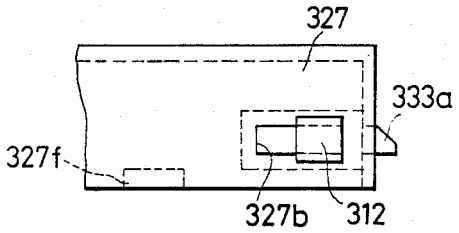
Figure 48:
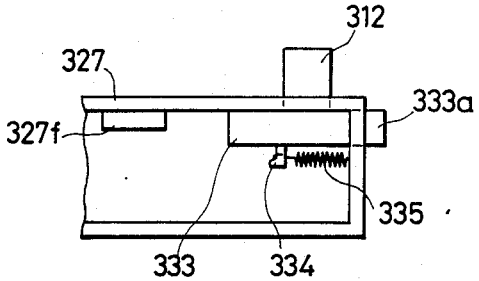
Figure 49:
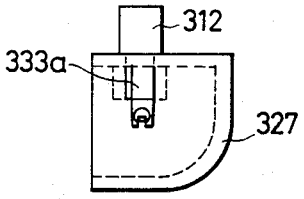

More specifically, as shown in FIGS. 47 to 49, an elongated hole 327*b* is formed in the upper surface of the platen 327 on the free end side along the longitudinal direction thereof. The locking lever 312 having a head portion larger than the width of the elongated hole 327*b* is fitted in the elongated hole 327*b* from the top.

The lower end of the locking lever 312 is fitted in a block 333 arranged below the elongated hole 327*b* through a shaft (not shown) having a diameter which is substantially the same as the width of the elongated hole 327*b*, as shown in FIGS. 47 to 49.

The block 333 is larger than the elongated hole 327*b*.

Therefore, the locking lever 312 and the block 333 are slidably arranged to sandwich the upper plate of the platen 327 therebetween.

A pawl 333*a*, which has an inclined surface at the side of the base 314, projects from the distal end of the block 333, and can slidably extend through the side wall of the platen 327 on the free end side.

A pin 334 projects from the lower surface of the block 333, and a tension coil spring 335 extends between the pin 334 and the side wall of the platen 327 on the free end side to bias the locking lever 312 and the block 333 to the right as shown in FIG. 45, thereby continuously projecting the pawl 333*a*.

On the side of the base 314, a side plate 336 vertically projects on the right side of the guide portion 324 as shown in FIG. 45.

A projection 336*a* defining an identical surface as that of the platen 327 is formed on the inner surface of the side plate 336, and a through hole 336*b* with which the pawl 333*a* is engaged is formed in the lower portion thereof.

An inclined surface 336*c* is formed on the distal end corner portion of the side plate 336. The inclined surface 336*c* can widen a recording paper mounting path when roll recording paper is mounted.

Therefore, when the locking lever 312 is pulled to disengage the pawl 333*a* from the through hole 336*b*, the platen 327 can be opened by the force of the torsion coil spring 329.

When the platen 327 is pushed toward the base 314 against the force of the torsion coil spring 329, the inclined surface of the pawl 333*a* is pushed by the side plate 336 and the block 333 is moved backward. Then, the pawl 333*a* is engaged with the through hole 336*b* by the force of the tension coil spring 335, thereby locking the platen 327.

At this time, the pinch roller shaft 331 is flexed and the pinch roller 332 is urged against the feed roller 325 to sandwich the recording paper therebetween through an opening 327*e* of the platen 327.

Note that the locking lever, the pawl, and the like may be arranged on the base 314 and the through hole may be formed in the platen.

Figure 50:
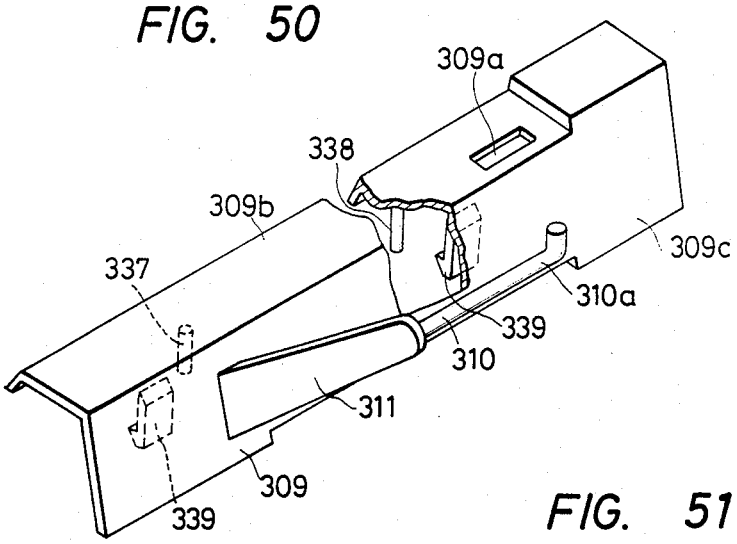

The platen cover 309 engaged with the platen 327 is arranged as shown in FIG. 50.

More specifically, the platen cover 309 has a roof-like shape to entirely cover the platen 327 and to constitute part of the outer appearance of the recording apparatus such as an electronic calculator. Positioning pins 337 and 338 project from the lower surface of an upper plate 309*b* of the cover 309, and are respectively fitted in a small hole 327*c* and an elongated hole 327*d* formed in the upper surface of the platen 327.

An elongated hole 309*a* which is engaged with the locking lever 312 is formed in one end portion of the platen cover 309.

Locking pawls 339 are formed on the upper end portion of the inner surface of the side plate 309*c* of the platen cover 309 and are separated by a predetermined distance.

These locking pawls 339 are hooked by projections 327*f* projecting inside the opening 327*a*. The roll paper holder 310 is provided integrally with the platen cover 309.

The platen cover 309 has the structure as described above. If the platen cover 309 is moved downward while the platen cover 309 is located above the platen 327 and the positioning pins 337 and 338 are fitted in the small hole 327*c* and the elongated hole 327*d*, respectively, the locking pawls 339 are hooked by the projections 327*f* while being elastically deformed. Thus, the platen cover 309 is mounted on the platen 309.

Figure 51:
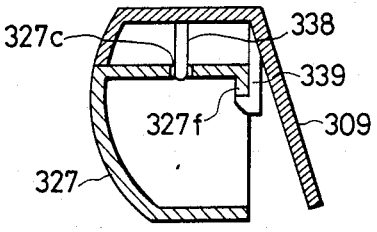

FIG. 51 illustrates this state.

The operation of this embodiment having the above arrangement will now be described.

When the recording paper is to be mounted, the locking lever 312 is pulled to the left as indicated by an arrow as shown in FIG. 44 from the state wherein the platen cover 309 is closed together with the platen 327. Then, the platen 327 and the platen cover 309 which are disengaged due to the force of the torsion coil spring 329 are pivoted clockwise in FIG. 43 about the supporting shaft 328 and are opened. Then, the platen 327 and the platen cover 309 abut against the stopper 330 and are stopped at a predetermined opening angle, e.g., about 45°.

At this time, the roll paper holder 310 is integrally pivoted.

In this state, the roll paper 313 is mounted on the horizontal arm 310*a* of the roll paper holder 310.

The roll paper is mounted so that one end 313*a* thereof is unattached from the lower side of the roll.

One end 313*a* of the recording paper is guided from below the opening platen 327, as shown in FIG. 43, and is then guided along the inner surface of the platen 327 through the insertion port 311.

In this state, the platen 327 is pivoted together with the platen cover 309 and is pushed toward the electronic calculator.

The pawl 333*a* then retracts as described above, and the inner edge of the platen 327 at the free end side abuts against the projection 336*a* of the side plate 336 and is thereby stopped. Then, the pawl 333*a* is engaged with the through hole 336*b* and is locked thereby.

One end 313*a* of the roll paper is clamped between the feed roller 325 and the pinch roller 332 at this time.

The urging force at this time is determined by the elastic force of the pinch roller shaft 331.

Figure 52:
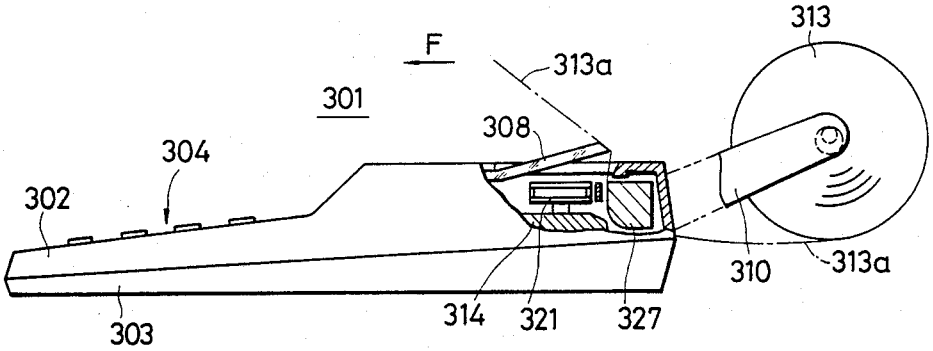

When the recording paper is mounted in this manner, one end 313*a* of the recording paper is moved upward along the platen 327 as shown in FIG. 52, and is then guided by the lower surface of the paper cutter 308 which is obliquely mounted. Then, the paper passes through a gap between the distal end of the paper cutter 308 and the platen cover 309 and is guided upward.

In this state, a recording operation is performed by operating the keyboard section 304.

In order to facilitate drawing or returning of the recording paper by a user, a driving mechanism for the feed roller 325 is often separated from a driving system in the printing standby mode. As a result, a recording paper holding force of the recording unit is decreased.

For this reason, when the recording paper is to be cut, one end 313*a* of the recording paper abuts against the distal end of the paper cutter 308 and is drawn toward the front side of the electronic calculator as indicated as arrow F in FIG. 52. When the paper cutter 308 is set at this time so that its distal end reaches a position behind the inner edge of the platen 327 to overlap it, the recording paper is strongly urged against the inner surface of the platen 327, and a large frictional resistance is generated, thereby increasing the recording paper holding force. Thus, even if the recording paper is strongly pulled for cutting, the recording paper can no longer be fed, and a good cutting operation can be performed. Therefore, if the paper cutter 308 is arranged as shown in FIG. 52, so that its distal end overlaps the inner edge of the platen 327, the platen 327 can be pivoted in a horizontal direction of the electronic calculator, and cannot interfere with the paper cutter 308.

Note that the present invention is not limited to the above embodiments, and various changes and modifications may be made.

What is claimed is:

1. A recording apparatus comprising:

means for performing a recording operation on paper drawn from a roll paper source on a recording surface thereof;

guide means having a first guide surface for guiding the drawn paper from the roll paper source to said recording means;

platen means having a second guide surface facing said first guide surface and a paper supporting surface facing said recording surface of said recording means;

holding means for holding said platen means to be movable between a first position at which said first and second guide surfaces face each other and a second position at which said first and second guide surfaces are separated from each other, said holding means holding said platen means, in the form of a cantilever, through a rotation shaft disposed at a position near an edge along a widthwise direction of the paper, the axis of said shaft being oriented in a direction perpendicular to the widthwise direction of the paper;

paper holding means, integrally fixed to said platen means, for holding the roll paper source, said paper holding means being positioned at the rear of a body of said apparatus and projecting from the exterior thereof, the paper holding means being rotated about said shaft together with said platen means as one body;

an insertion port through which an end of the paper can be inserted; and setting means for supplying to said recording surface the paper inserted into said insertion port;

wherein when said platen means is moved to the second position separated from said recording surface, the paper can be supplied to said recording surface from a side of an open end of said platen means opposite from a side where said platen means is supported by said holding means, and wherein when said platen means is in the first position an end of the paper can be inserted into said insertion port to enable said setting means to supply the paper to said recording surface.

2. An apparatus according to claim 1, wherein said paper holding means is fixed to a surface of said platen means opposite to the paper supporting surface.

3. An apparatus according to claim 2, wherein said platen means includes a platen main body having the paper supporting surface and a cover member detachably held by said platen main body, and said paper holding means is fixed to said cover member.

4. An apparatus according to claim 1, further including biasing means for biasing said platen means to the separating position and locking means for locking said platen means at the first mounting position.

* * * * *

UNITED STATES PATENT AND TRADEMARK OFFICE

CERTIFICATE OF CORRECTION

PATENT NO. : 4,984,916

DATED : January 15, 1991

INVENTOR(S) : Kazumi Sekine, et al

It is certified that error appears in the above-identified patent and that said Letters Patent is hereby corrected as shown below:

On the title page;

[56] REFERENCES CITED
U.S. Patent Documents

"3,905,462 9/1972 Nowak" should read --3,905,462 9/1975 Nowak--.

[57] Abstract

Line 15, "and" should be deleted.
Line 16, "along and" should be deleted.

COLUMN 1:

Line 33, "miniaturize" should read --miniaturized--.

COLUMN 3:

Line 53, "calculator" should read --calculator.--.

COLUMN 5:

Line 6, "3C" should read --3C,--.

COLUMN 10:

Line 24, "mode" should read --mode.--.

UNITED STATES PATENT AND TRADEMARK OFFICE

CERTIFICATE OF CORRECTION

PATENT NO. : 4,984,916

DATED : January 15, 1991

INVENTOR(S) : Kazumi Sekine, et al

It is certified that error appears in the above-identified patent and that said Letters Patent is hereby corrected as shown below:

COLUMN 11:

Line 3, "106." should read --101.--.
Line 33, "guide portion 124" should read --guide portion 124.--.

COLUMN 12:

Line 49, "cf" should read --of--.
Line 66, "149" should read --149.--.

COLUMN 13:

Line 16, "add" should read --and--.

COLUMN 17:

Line 6, "paper cutter 208" should read --paper cutter 208.--.

UNITED STATES PATENT AND TRADEMARK OFFICE

CERTIFICATE OF CORRECTION

PATENT NO. : 4,984,916

DATED : January 15, 1991

INVENTOR(S) : Kazumi Sekine, et al

It is certified that error appears in the above-identified patent and that said Letters Patent is hereby corrected as shown below:

COLUMN 20:

Line 23, "platen 309." should read --platen 327.--.

Signed and Sealed this

First Day of December, 1992

*Attest:*

DOUGLAS B. COMER

*Attesting Officer*

*Acting Commissioner of Patents and Trademarks*